US010807392B2

(12) United States Patent
Akahane

(10) Patent No.: US 10,807,392 B2
(45) Date of Patent: Oct. 20, 2020

(54) TRANSPORT DEVICE AND PRINTING DEVICE

(71) Applicant: Seiko Epson Corporation, Tokyo (JP)

(72) Inventor: Takashi Akahane, Kamiina-Gun (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/482,207

(22) PCT Filed: Jan. 16, 2018

(86) PCT No.: PCT/JP2018/000971

§ 371 (c)(1),
(2) Date: Jul. 30, 2019

(87) PCT Pub. No.: WO2018/139263

PCT Pub. Date: Aug. 2, 2018

(65) Prior Publication Data

US 2019/0344595 A1 Nov. 14, 2019

(30) Foreign Application Priority Data

Jan. 30, 2017 (JP) ..... 2017-014830
Jan. 30, 2017 (JP) ..... 2017-014831

(51) Int. Cl.
*B41J 15/16* (2006.01)
*B65H 23/16* (2006.01)
*B65H 23/188* (2006.01)

(52) U.S. Cl.
CPC ..... *B41J 15/16* (2013.01); *B65H 23/16* (2013.01); *B65H 23/188* (2013.01)

(58) Field of Classification Search
CPC ..... B41J 15/16; B41J 11/42; B65H 23/16; B65H 23/188
See application file for complete search history.

(56) References Cited

U.S. PATENT DOCUMENTS 5,791,541 A 8/1998 Jitsuishi et al.
5,996,492 A 12/1999 Jurkewitz et al.
(Continued)

FOREIGN PATENT DOCUMENTS

CN 105365412 3/2016
JP H10-181971 10/1998
(Continued)

*Primary Examiner* — Justin Seo
(74) *Attorney, Agent, or Firm* — Workman Nydegger

(57) ABSTRACT

Provided are a transport device and a printing device configured to minimize fluctuation in a tension of a medium in a portion between a first transport unit and a second transport unit. A transport device provided to a printing device includes a transport mechanism serving as an example of the first transport unit, a winding unit serving as the second transport unit disposed downstream of the transport mechanism in a transport direction, a tension imparting unit provided with a tension bar serving as an example of a tension imparting member biased toward a medium between the transport mechanism and the winding unit and configured to impart tension to the medium, and a biasing force adjustment unit serving as an adjustment unit configured to adjust at least one of a biasing force of the tension bar and a relative speed between the tension bar and the medium.

15 Claims, 17 Drawing Sheets

(56) References Cited

U.S. PATENT DOCUMENTS

| | | | | |
|---|---|---|---|---|
| 9,610,789 | B2 | 4/2017 | Kato | |
| 2006/0269348 | A1* | 11/2006 | Nagata | B41J 11/0095 400/615.2 |
| 2015/0225196 | A1 | 8/2015 | Hamano | |
| 2015/0328909 | A1 | 11/2015 | Takizawa | |
| 2016/0039231 | A1 | 2/2016 | Kato | |
| 2016/0096384 | A1 | 4/2016 | Kumai et al. | |
| 2016/0107461 | A1 | 4/2016 | Takizawa | |
| 2017/0050452 | A1 | 2/2017 | Hamano | |
| 2017/0106682 | A1 | 4/2017 | Akahane et al. | |
| 2017/0173983 | A1 | 6/2017 | Kumai et al. | |

FOREIGN PATENT DOCUMENTS

| | | |
|---|---|---|
| JP | H10-264361 | 10/1998 |
| JP | 2007-055791 | 3/2007 |
| JP | 2009-062150 | 3/2009 |
| JP | 2013-022744 | 2/2013 |
| JP | 2011-011889 | 6/2014 |
| JP | 2015-147394 | 8/2015 |
| JP | 2015-218032 | 12/2015 |
| JP | 2016-068511 | 5/2016 |
| JP | 2016-068514 | 5/2016 |
| JP | 2017-039248 | 2/2017 |
| JP | 2017-074738 | 4/2017 |
| JP | 2017-074739 | 4/2017 |

* cited by examiner

TRANSPORT DEVICE AND PRINTING DEVICE

TECHNICAL FIELD

The present disclosure relates to a transport device configured to transport a medium of a print target, and a printing device including the transport device.

BACKGROUND ART

There are, for example, printing devices configured to perform printing on a large-size medium which include a transport device configured to transport a medium in a so-called roll-to-roll scheme. This type of transport device includes a transport unit (one example of a first transport unit) that transports an elongated medium supplied from a roll body, and a winding unit (one example of a second transport unit) that winds the medium printed by a printing unit into a roll shape at a position downstream of the transport unit in a transport direction of the medium. For example, in Patent Document 1, there is disclosed a transport device provided with a tension imparting unit (tension imparting mechanism) that imparts tension to the medium in a portion between the transport unit and the winding unit to stably wind the medium around the winding unit. The transport device includes a tension imparting mechanism provided with a tension imparting member (tension bar) supported by a pair of arms and configured to bias a medium having a strip shape by its own dead weight to impart tension to the medium. The transport device controls the winding unit by using sensors configured to sense that the tension imparting member has reached an upper limit position and a lower limit position, causing the tension imparting member to swing within a certain angular range and thus cause tension to act on the medium within a predetermined range.

CITATION LIST

Patent Literature

[PTL 1] JP-A-2013-22744

SUMMARY OF INVENTION

Technical Problem

Nevertheless, in the tension imparting mechanism described in PTL 1, when the transport unit starts transporting the medium, slack is created first in the medium in a portion between the transport unit and the winding unit, and then, slightly later, the tension imparting member drops onto the medium by its own dead weight. Thus, unable to follow the slack of the medium associated with the transporting of the medium, the tension imparting member moves toward the temporarily separated medium in a direction that biases the medium, and then excessive tension tend to be generated in the medium when the moving tension imparting member collides with the medium. This type of excessive tension presents the problem of causing a relatively large amount of fluctuation in a tension of the medium in a portion between the first transport unit (the transport unit, for example) and the second transport unit (the winding unit, for example). Tension fluctuation of this type induces, for example, displacement of the medium in at least one of the transport unit and the winding unit. Note that this type of problem is not limited to a configuration in which the tension imparting member biases the medium by its own dead weight, but is generally common even in configurations that bias the medium in other ways, such as by use of a spring or the like.

An object of the present disclosure is to provide a transport device and a printing device capable of minimizing fluctuation in a tension of a medium in a portion between a first transport unit and a second transport unit.

Solution to Problem

A transport device for solving the above-described problems includes a first transport unit, a second transport unit disposed downstream of the first transport unit in a transport direction, a tension imparting unit provided with a tension imparting member biased toward a medium between the first transport unit and second transport unit and configured to impart tension to the medium, and an adjustment unit configured to adjust at least one of a biasing force of the tension imparting member and a relative speed between the tension imparting member and the medium.

According to this configuration, the tension imparting member imparts tension to the medium by biasing the medium in the portion between the first transport unit and the second transport unit. Due to a speed difference between a transport speed of the first transport unit and a transport speed of the second transport unit, slack and pull is generated in the medium. Further, as a result of the relative speed difference between the tension imparting member and the medium, excessive tension is applied to the medium when a phenomenon is generated in which the tension imparting member cannot follow the transport speed of the medium and collides with the medium after being temporarily separated from the medium. That is, slack is generated in the medium when the transport speed of the first transport unit is greater than the transport speed of the second transport unit, and the medium is pulled when the transport speed of the first transport unit is less than the transport speed of the second transport unit, or when excessive tension is applied to the medium. While the slack and pull generated in the medium cause fluctuation in the tension in the medium, the adjustment unit adjusts at least one of the biasing force of the tension imparting member and the relative speed between the tension imparting member and the medium, making it possible to minimize the fluctuation in the tension of the medium in the portion between the first transport unit and the second transport unit. For example, displacement of the medium caused by the fluctuation in the tension of the medium in the portion between the first transport unit and the second transport unit can be suppressed by at least one of the first transport unit and the second transport unit.

A transport device for solving the above-described problems includes a first transport unit, a second transport unit disposed downstream of the first transport unit in a transport direction, a tension imparting unit provided with a tension imparting member biased toward a medium between the first transport unit and second transport unit and configured to impart tension to the medium, a detector configured to detect the tension imparting member approaching to the medium so that a distance therebetween is less than or equal to a distance threshold value, and, when the detector detects the approach, an adjustment unit adjusts a relative speed between the tension imparting member and the medium to a value less than the relative speed obtained when adjustment is not performed.

According to this configuration, when the transport speed of the first transport unit is greater than the transport speed of the second transport unit, slack is generated in the medium in the portion between the first transport unit and the second transport unit, and a phenomenon is generated in which the tension imparting member cannot follow the medium and collides with the medium after being temporarily separated from the medium. At this time, when the detector detects the tension imparting member and the medium approaching each other so that a distance therebetween is less than or equal to the distance threshold value in the process of the tension imparting member colliding with the medium, the adjustment unit adjusts the relative speed between the tension imparting member and the medium to a value less than the relative speed of a case without performing an adjustment. Thus, it is possible to suppress excessive tension from being imparted to the medium when the tension imparting member comes into contact with the temporarily separated medium.

In the transport device described above, the detector may be provided to the tension imparting member.

According to this configuration, it is possible to detect the approach of the tension imparting member to the medium without the medium or the tension imparting member being an obstruction.

In the transport device described above, the detector may be of contact type implementing detection by contacting with the medium.

When the medium is a transparent medium or a mesh-like (net-like) medium, an optical detector cannot detect the medium and thus cannot detect the approach of the tension imparting member to the medium. However, according to this configuration, the detector is a contact type configured to detect upon contact with the medium, and thus, even with a transparent medium or a mesh-like medium, can detect the approach of the tension imparting member to the medium.

In the transport device described above, when the detector detects the tension imparting unit and the medium approaching each other so that a distance therebetween is less than or equal to the distance threshold value, the adjustment unit adjusts the relative speed by controlling the second transport unit.

According to this configuration, the adjustment unit adjusts the relative speed between the tension imparting member and the medium to a value less than the relative speed of a case without performing an adjustment by controlling the second transport unit. That is, the relative speed between the tension imparting member and the medium is adjusted by adjusting the speed of the medium. As a result, a unit configured to adjust the speed of the tension imparting member to adjust the relative speed need not be provided, and the configuration of the transport device can be simplified compared to a configuration provided with this type of unit.

In the transport device described above, the adjustment unit may include a biasing force adjustment unit configured to adjust a biasing force of the tension imparting member and, when the detector detects the tension imparting member and the medium approaching each other so that a distance therebetween is less than or equal to the distance threshold value, the biasing force adjustment unit adjusts the biasing force of the tension imparting member to be smaller in comparison with a biasing force obtained when adjustment is not performed.

According to this configuration, when the detector detects the tension imparting member and the medium approaching each other so that a distance therebetween is less than or equal to the distance threshold value, the biasing force adjustment unit adjusts the biasing force of the tension imparting member to a small value compared to the biasing force of a case without performing an adjustment. As a result, the tension generated in the medium when the tension imparting member and the medium collide can be relatively minimized.

In the transport device described above, when the detector detects the tension imparting member and the medium approaching each other so that a distance therebetween is less than or equal to the distance threshold value the biasing force adjustment unit may impart a braking force to the tension imparting member.

According to this configuration, when the detector detects the tension imparting member and the medium approaching each other so that a distance therebetween is less than or equal to the distance threshold value, a braking force is imparted to the tension imparting member, reducing the movement speed of the tension imparting member compared to a case without performing an adjustment. As a result, the relative speed when the tension imparting member and the medium collide can be minimized. Thus, it is possible to prevent excessive tension from being imparted to the medium when the tension imparting member collides with the medium.

In the transport device described above, the detector may include a tension imparting member position acquiring unit configured to acquire a position of the tension imparting member, and a medium position acquiring unit configured to acquire a position of the medium, and detect the tension imparting member and the medium approaching each other so that a distance therebetween is less than or equal to the distance threshold value, based on the position of the tension imparting member acquired by the tension imparting member position acquiring unit and the position of the medium acquired by the medium position acquiring unit.

According to this configuration, even when a detector such as a sensor is not provided, it is possible to detect the tension imparting member and the medium approaching each other so that a distance therebetween is less than or equal to the distance threshold value, based on the position of the tension imparting member and the position of the medium.

A transport device for solving the above-described problems includes a first transport unit, a second transport unit disposed downstream of the first transport unit in a transport direction, a tension imparting unit provided with a tension imparting member biased toward a medium between the first transport unit and second transport unit and configured to impart tension to the medium, and a biasing force adjustment unit configured to adjust a biasing force of the tension imparting member.

According to this configuration, the tension imparting member imparts tension to the medium by biasing the medium in the portion between the first transport unit and the second transport unit. Due to a speed difference between a transport speed of the first transport unit and a transport speed of the second transport unit, slack and pull is generated in the medium. That is, slack is generated in the medium when the transport speed of the first transport unit is greater than the transport speed of the second transport unit, and the medium is pulled when the transport speed of the first transport unit is less than the transport speed of the second transport unit. While the slack and pull generated in the medium cause fluctuation in the tension in the medium, the biasing force adjustment unit adjusts the biasing force of the tension imparting member, making it possible to minimize the fluctuation in the tension of the medium in the portion between the first transport unit and the second transport unit. For example, displacement of the medium caused by the fluctuation in the tension of the medium in the portion between the first transport unit and the second transport unit can be suppressed in at least one of the first transport unit and the second transport unit.

Preferably, the transport device described above further includes a detector configured to detect the tension imparting member and the medium approaching each other so that a distance therebetween is less than or equal to the distance threshold value, and when the detector detects the tension imparting member and the medium approaching each other, the biasing force adjustment unit adjusts the biasing force of the tension imparting member.

According to this configuration, when the transport speed of the first transport unit is greater than the transport speed of the second transport unit, the tension imparting member cannot follow the movement of the medium in the portion between the first transport unit and the second transport unit and, even when the tension imparting member is temporarily separated from the medium, the biasing force adjustment unit adjusts the biasing force of the tension imparting member to a small value upon detection of the tension imparting member and the medium to a value approaching each other so that a distance therebetween is less than or equal to the distance threshold value. Thus, the impact when the tension imparting member collides with the medium can be alleviated while minimizing a delay in the following of the medium by the tension imparting member.

In the transport device described above, the detector may be of contact type implementing detection by contacting with the medium.

However, when the medium is a transparent medium or a mesh-like (net-like) medium, an optical detector cannot detect the medium and thus cannot detect the approach of the medium. However, according to this configuration, the detector is a contact type configured to detect upon contact with the medium, and thus, even with a transparent medium or a mesh-like medium, can detect the approach of the medium.

In the transport device described above, the biasing force adjustment unit may be a braking force generating unit configured to generate in the tension imparting unit a braking force in a direction of reducing the biasing force.

According to this configuration, the biasing force is adjusted to a small value by the braking force generated in the tension imparting unit by the braking force generating unit, compared to when the braking force is not generated. Thus, it is possible to alleviate the impact when the tension imparting member collides with the medium, and avoid the generation of excessive tension in the medium.

In the transport device described above, the braking force generating unit may generate the braking force by applying a load to the tension imparting unit, the load being obtained by any one of a driving force of a drive source, a frictional load, a viscous load, an elastic load, and a center-of-gravity shift of the tension imparting unit.

According to this configuration, the braking force is generated by applying a load by any one of the driving force of the drive source, the frictional load, the viscous load, the elastic load, and the center-of-gravity shift of the tension imparting unit to the tension imparting unit. Thus, a braking force can be applied to the tension imparting member by a relatively simple configuration, and the biasing force of the tension imparting member can be adjusted to a small value.

In the transport device described above, the braking force generating unit may be configured to adjust the braking force generated in the tension imparting unit.

According to this configuration, the braking force generated in the tension imparting unit can be adjusted in accordance with a difference in a position (movement start position) at the start of movement of the tension imparting member and a difference in the relative speed when the tension imparting member and the medium come into contact with each other by only the biasing force of the tension imparting member itself. Thus, the relative speeds of both the tension imparting member and the medium when the tension imparting member and the medium come into contact can be reduced within a desired predetermined range.

In the transport device described above, the braking force generating unit may change the braking force in accordance with a position of the tension imparting member when the first transport unit starts transporting the medium.

According to this configuration, different braking forces are imparted to the tension imparting unit in accordance with the position of the tension imparting member when the first transport unit starts transporting the medium. Thus, the relative speed when the tension imparting member and the medium come into contact can be reduced to a small value within an appropriate predetermined range regardless of the movement start position of the tension imparting member. Accordingly, it is possible to appropriately alleviate the impact (collision energy) when the tension imparting member collides with the medium, and apply an appropriate tension to the medium. For example, it is possible to avoid a situation in which excessive tension is generated in the medium or the tension in the medium is insufficient.

A printing device configured to solve the above-described problems includes the transport device described above and a printing unit configured to perform printing on the medium transported by the transport device.

According to this configuration, the printing device includes the above-described transport device configured to transport the medium on which printing is to be performed by the printing unit, and therefore the same acting effects as those of the transport device can be achieved. Thus, a high-quality printed material can be provided.

DESCRIPTION OF EMBODIMENTS

First Exemplary Embodiment

A first exemplary embodiment of a printing device will be described below with reference to the accompanying drawings. The printing device is, for example, a large format printer (LFP) that performs printing (recording) on an elongated medium of a large size. Note that, in each of the drawings below, to illustrate each of members and the like in a recognizable size, each of the members and the like is illustrated to a scale different from an actual scale. FIG. 1 to FIG. 4 and the like illustrate X axis, Y axis, and Z axis as three axes orthogonal to one another for the convenience of explanation, where the tip end side of the arrow indicating the axial direction is defined as "+ side" and the base end side as "− side". Herein, a direction parallel to the X axis is referred to as "X axis direction", a direction parallel to the Y axis as "Y axis direction", and a direction parallel to the Z axis as "Z axis direction".

Figure 1:
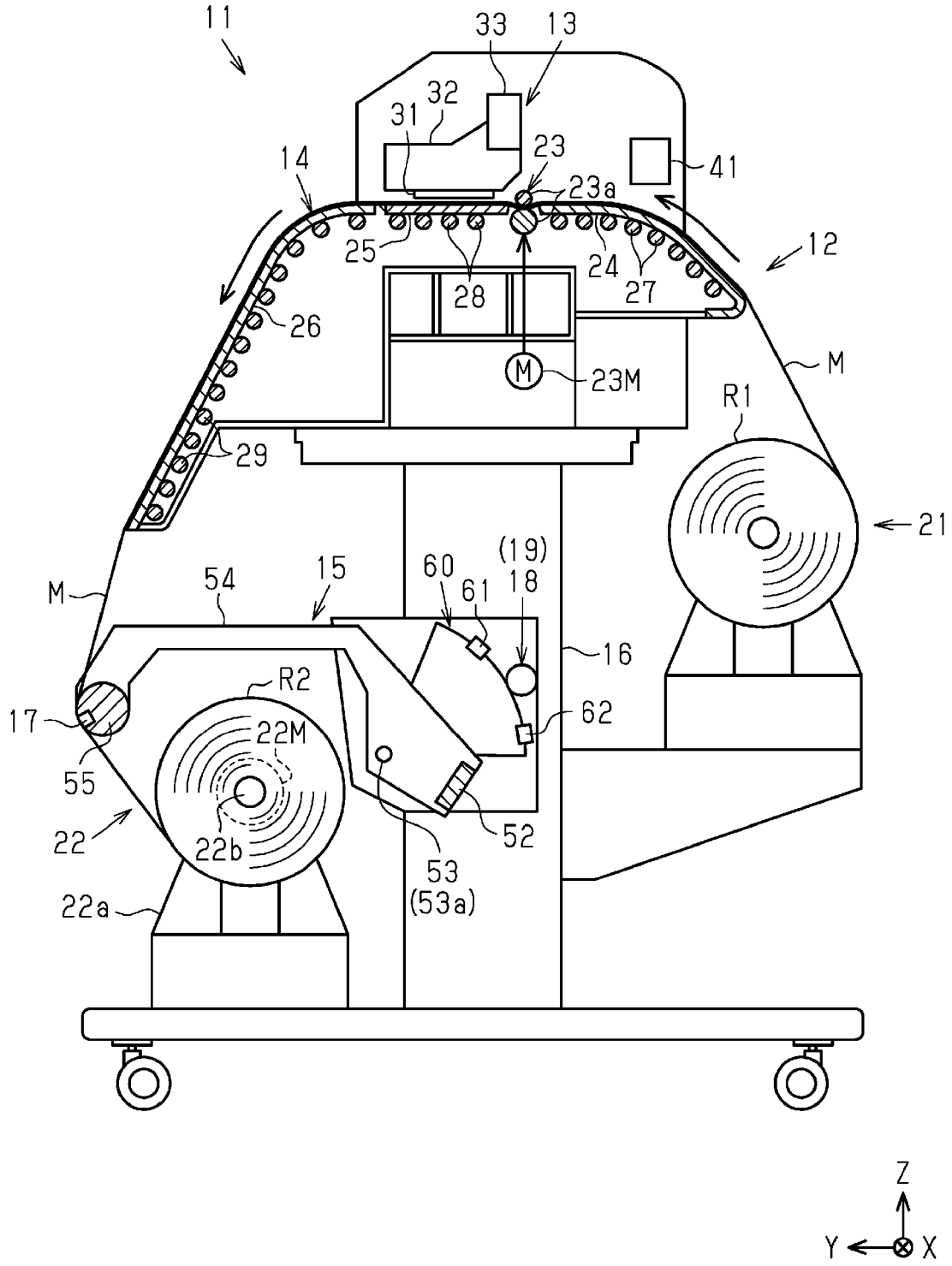
FIG. 1 is a cross-sectional view illustrating a schematic configuration of a printing device according to a first exemplary embodiment.

First, description is made of a configuration of the printing device. The printing device is, for example, an ink jet-type large format printer. As illustrated in FIG. 1, a printing device 11 includes a transport device 12 configured to transport a medium M in a roll-to-roll scheme, a printing unit 13 configured to discharge an ink serving as an example of a liquid to a predetermined region of the medium M to print an image, a text and the like, a medium support unit 14 configured to support the medium M, a tension imparting unit 15, and a control unit 41 configured to control these constitutional components. The constitutional components are supported by a main body frame 16 provided with a carriage. Note that the medium M is made of a vinyl chloride film and the like having a width of about 64 inches. In the exemplary embodiment, a vertical direction along the gravity direction is referred to as "Z-axis direction", a direction in which the medium M is transported in the printing unit 13 is referred to as "Y-axis direction", and a width direction of the medium M is referred to as "X-axis direction".

The transport device 12 includes a feeding unit 21 configured to feed out the medium M in a roll shape to the printing unit 13 in a transport direction (arrow direction in the drawing), and a winding unit 22 configured to wind the fed medium M printed and fed out by the printing unit 13. The transport device 12 includes a transport mechanism 23 in the middle of a transport path between the feeding unit 21 and the winding unit 22 configured to transport the medium M in the transport direction. The transport mechanism 23 includes a pair of transport rollers 23*a* and a transport motor 23M configured to output a rotational power to the pair of transport rollers 23*a*. The transport mechanism 23 illustrated in FIG. 1 is an example in which there is one pair of transport rollers 23*a*, but may include a plurality of pairs of transport rollers 23*a*. Further, the transport unit 23 is not limited to a roller-type transport mechanism, and may at least partially include a belt-type transport mechanism including a transport belt on which the medium M is carried for transporting. Note that in this exemplary embodiment, the transport mechanism 23 corresponds to an example of the first transport unit, and the winding unit 22 corresponds to an example of the second transport unit.

In the feeding unit 21, a roll body R1 with an unused medium M winding and overlapping in a cylindrical manner is held. The feeding unit 21 is replaceably loaded with the roll bodies R1 having a plurality of sizes different in width of the medium M (length in the X-axis direction) and the number of windings. Then, when the feeding unit 21 rotates the roll body R1 counterclockwise in FIG. 1 by a power of a feeding motor (not illustrated), the medium M is unwound from the roll body R1 and fed to the printing unit 13. The winding unit 22 forms a roll body R2 obtained as a result of the medium M printed in the printing unit 13 being wound in a cylindrical manner. The winding unit 22 includes a pair of holders 22*a* provided with a pair of winding shafts 22*b* configured to support a cylinder-like core material for forming the roll body R2 by winding the medium M, and a winding motor 22M configured to output a power for rotating the pair of winding shafts 22*b*. When the winding motor 22M is driven so that the winding shaft 22*b* is rotated counterclockwise in FIG. 1, the medium M is wound around the core material supported by the winding shaft 22*b* so that the roll body R2 is formed.

The printing unit 13 includes a recording head 31 capable of discharging the ink toward the medium M, and a carriage moving unit 33 configured to reciprocate a carriage 32 on which the recording head 31 is mounted in a direction intersecting with the transport direction (X-axis direction). The recording head 31 includes a plurality of nozzles, and is configured to be capable of discharging the ink from each of the plurality of nozzle. When a main scanning where the ink is discharged from the recording head 31 while reciprocating, by the carriage moving unit 33, the carriage 32 in the X-axis direction and a sub scanning where the transport mechanism 12 transports the medium M in the transport direction are repeated, an image, a text, and the like are printed on the medium M.

The medium support unit 14 is configured to be capable of supporting the medium M in the transport path of the medium M, and includes a first support unit 24 disposed between the feeding unit 21 and the transport mechanism 23, a second support unit 25 facing the printing unit 13, and a third support unit 26 disposed between a downstream end of the second support unit 25 and the winding unit 22.

The printing device 11 includes a first heater (pre-heater) 27 configured to heat the medium M, a second heater 28, and a third heater (after-heater) 29. When the control unit 41 drives the first, second, and third heaters 27, 28 and 29, a surface supporting the medium M in the medium support unit 14 is heated by heat conduction, and the medium M is heated from a back side of the medium M. The first heater 27 heats the first support unit 24 to preheat the medium M upstream of the printing unit 13 in the transport direction (on the −Y-axis side). The second heater 28 heats the second support unit 25, and heats the medium M in a discharge region of the printing unit 13. The third heater 29 heats the third support unit 26 and heats the medium M on the third support unit 26 so that, of the ink landed on the medium M, an undried ink is completely dried and fixed at least before the medium M is wound by the winding unit 22.

The tension imparting unit 15 imparts tension to the medium M in a portion between the transport mechanism 23 and the winding unit 22. The tension imparting unit 15 of this exemplary embodiment imparts tension to a portion of the medium M extending in the air between the winding unit 22 and a downstream end (that is, a lower end of the third support unit 26) in the transport direction of the medium support unit 14. The tension imparting unit 15 includes a tension bar 55 as an example of the tension imparting member that pivots about a pivoting shaft 53, and the tension bar 55 imparts tension to the medium M by coming into contact with the back surface of the medium M on which an image and the like are printed by the printing unit 13.

Figure 2:
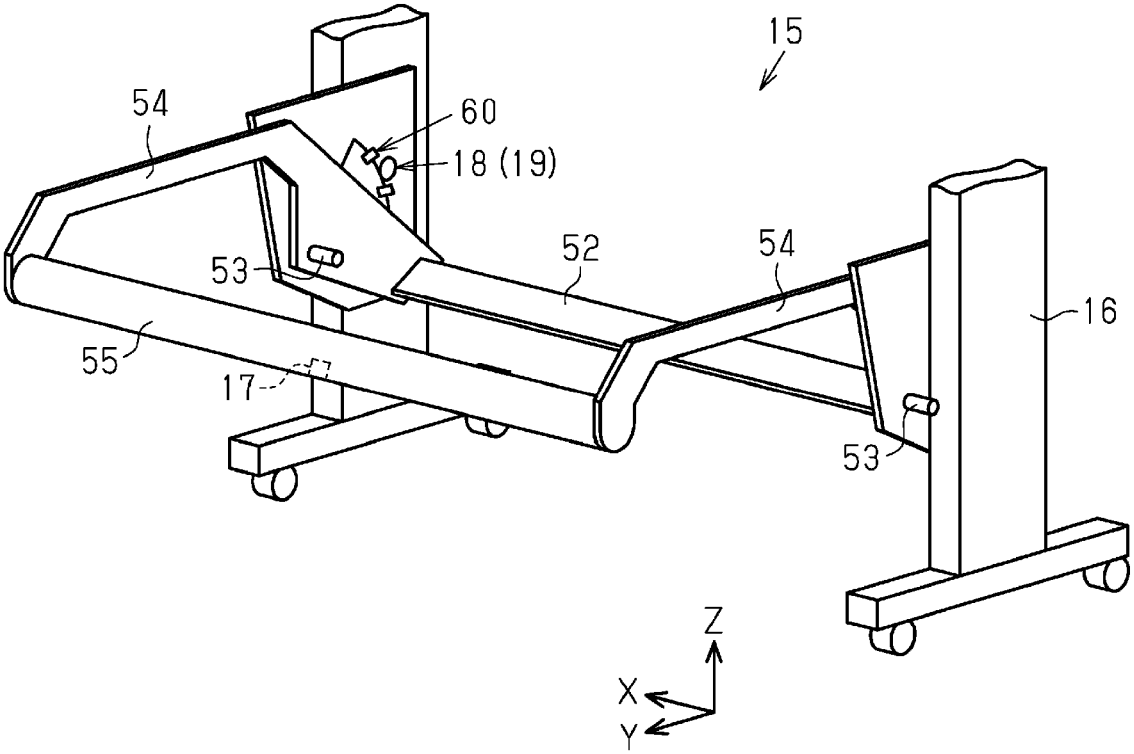
FIG. 2 is a perspective view illustrating a configuration of a tension imparting unit.

Next, the configuration of the tension imparting unit 15 will be described with reference to FIG. 1 and FIG. 2. In particular, as illustrated in FIG. 1 and FIG. 2, the tension imparting unit 15 includes a pair of arms 54 configured to pivot about the pivoting shaft 53, the tension bar 55 supported at each first end of the pair of arms 54 and capable of coming into contact with the medium M, and a counterweight 52 supported at each second end of the pair of arms 54. The tension bar 55 and the counterweight 52 *f* are long members connected by base end portions and tip end portions of the pair of arms 54 in the width direction (Y-axis direction).

The tension bar 55 is of columnar shape and is formed to be longer in a width direction than a width of the medium M. The counterweight 52 is of cuboid shape, and formed to have substantially the same length as the tension bar 55. The tension bar 55 and the counterweight 52 constitute a weight portion of the tension imparting unit 15. The pair of arms 54 are supported by the pivoting shaft 53 disposed in the main body frame 16 between the tension bar 55 and the counterweight 52 disposed at the both ends in a longitudinal direction of each of the pair of arms 54. Thus, the tension imparting unit 15 is pivotable about the pivoting shaft 53, and the tension bar 55 imparts tension to the medium M by coming into contact with the back surface of the medium M on which an image and the like are printed by the printing unit 13.

The pair of arms 54 have shapes curved convexly upward in the vertical direction (Z-axis direction). With this shape, the tension bar 55 can contact the medium M while avoiding the holders 22*a* and the like disposed at the both ends in the width direction (X-axis direction) of the medium M of the winding unit 22 and configured to support a shaft for winding the medium M, and thus, it is possible to decrease a dimension in the width direction of the tension imparting unit 15. As a result, it is possible to reduce an occasion where the tension imparting unit 15 comes into contact with another object such as an operator. Further, the tension bar 55 and the counterweight 52 are configured of a long member connecting the pair of arms 54, and thus a torsional rigidity of the tension imparting unit 15 is improved, as a result of which it is possible to prevent a deformation of the tension imparting unit 15 even if the tension imparting unit 15 comes into contact with the other object. Further, the transport device 12 of this exemplary embodiment includes a detector 17 configured to detect the tension bar 55 and the medium M approaching each other so that a distance therebetween is less than a distance threshold value. Furthermore, the transport device 12 includes a biasing force adjustment unit 18 serving as an example of an adjustment unit capable of adjusting a biasing force of the tension bar 55 toward the medium M. Note that a detailed configuration of the detector 17 and the biasing force adjustment unit 18 will be described later.

Next, a pivoting range of the tension bar 55 will be described with reference to FIG. 3 to FIG. 5. The printing device 11 includes a sensor unit 60 configured to find an upper limit position P1 and a lower limit position P2 of the tension bar 55. The sensor unit 60 includes an upper limit sensor 61, a lower limit sensor 62, and a flag plate 63. The flag plate 63 forms a fan-like shape around the pivoting shaft 53, and is disposed at the arm 54. The upper limit sensor 61 and the lower limit sensor 62 are transmissive type photosensors, and are provided at positions where an outer peripheral edge (circular arc portion) of the flag plate 63 can be sensed.

The configuration of the lower limit sensor 62 will now be described. Note that the configuration of the upper limit sensor 61 is the same as the configuration of the lower limit sensor 62, and thus descriptions of the configuration of the upper limit sensor 61 will be omitted. As illustrated in FIG. 5, the lower limit sensor 62 includes a light emitting unit 65 provided with a light emitting element or the like configured to emit light, and a light receiving unit 66 provided with a light receiving element or the like configured to receive light. The light emitting unit 65 and the light receiving unit 66 are provided to face each other. The lower limit sensor 62 is provided in the body frame 16. The flag plate 63 is pivotably disposed between the light emitting unit 65 and the light receiving unit 66. FIG. 3 illustrates a state in which light emitted from the light emitting unit 65 is blocked by the flag plate 63 and not received by the light receiving unit 66. At this time, the lower limit sensor 62 outputs a signal of "OFF". The flag plate 63 pivots counterclockwise about the pivoting shaft 53 with the pivoting of the arm 54 (tension imparting unit 15) from the state in FIG. 3. When a lower limit end portion 63*a* of the flag plate 63 reaches the position illustrated in FIG. 4 from the position illustrated in FIG. 3, the flag plate 63 is removed from the area between the light emitting unit 65 and the light receiving unit 66, and the light emitted from the light emitting unit 65 is in a state of being received by the light receiving unit 66. At this time, the lower limit sensor 62 outputs a signal of "ON".

Figure 3:
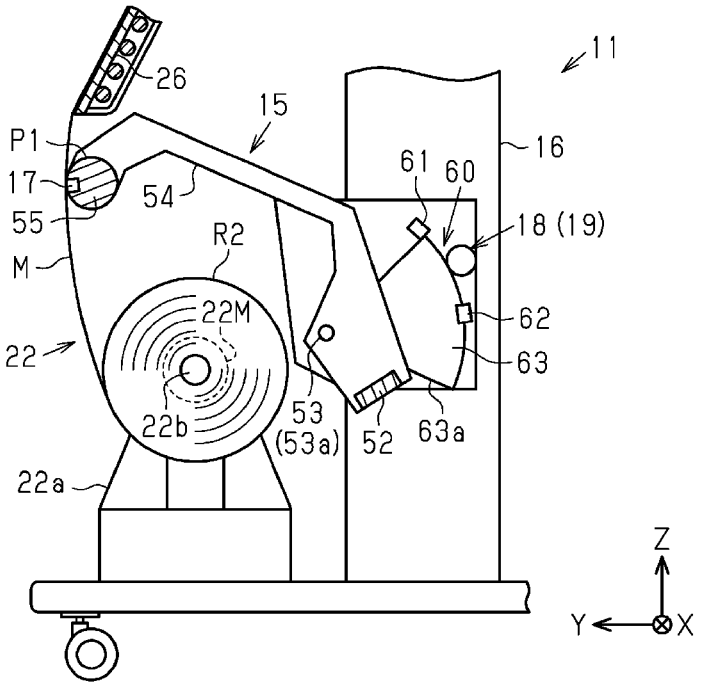
FIG. 3 is a side cross-sectional view illustrating an upper limit position of a tension bar.
Figure 4:
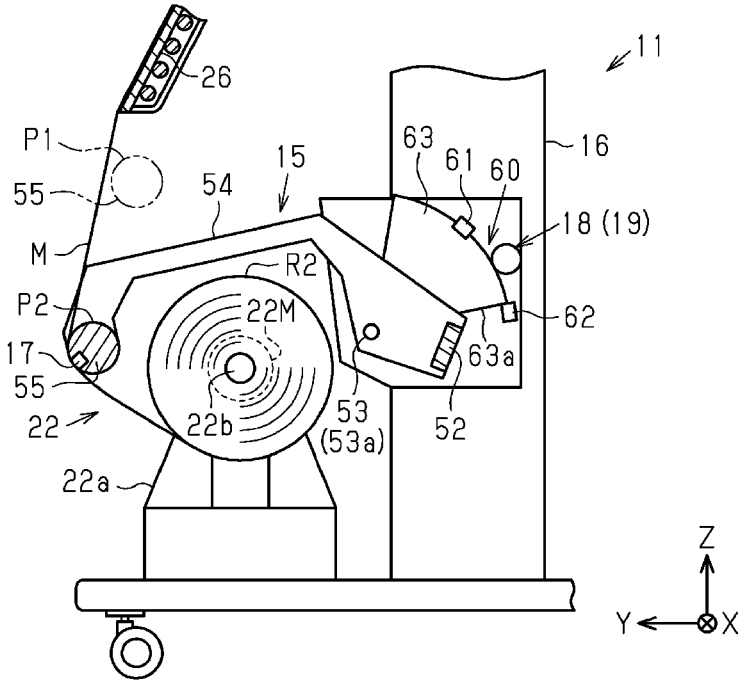
FIG. 4 is a side cross-sectional view illustrating a lower limit position of the tension bar.
Figure 5:
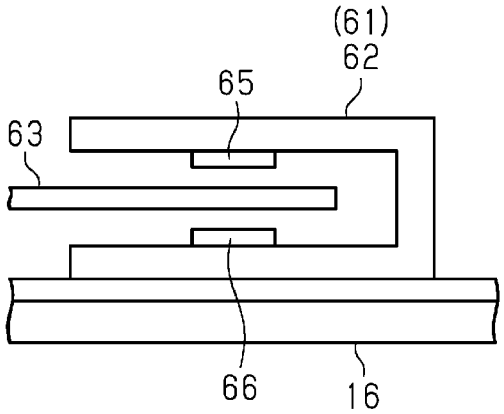
FIG. 5 is a cross-sectional view illustrating a configuration of a lower limit sensor.

The tension imparting unit 15 imparts tension to the medium M in a range of the position of the tension bar 55 from the upper limit position P1 illustrated in FIG. 3 to the lower limit position P2 illustrated in FIG. 4. Specifically, the medium M printed by the printing unit 13 is transported by the driving of the transport mechanism 23, and fed sequentially from the downstream end of the medium support unit 14. As a result, as the length of the medium M between a tip end of the third support unit 26 and the winding unit 22 gradually increases, the tension bar 55 positioned in the upper limit position P1 gradually pivots (drops) toward the lower limit position P2 about the pivoting shaft 53 by its own dead weight. When the tension bar 55 reaches the lower limit position P2, the flag plate 63 pivoted along with the arm 54 is removed from the area between the light emitting unit 65 and the light receiving unit 66 of the lower limit sensor 62, and a signal of "ON" is output from the lower limit sensor 62.

Upon receiving the signal of "ON" output from the lower limit sensor 62, the control unit 41 drives the winding motor 22M that winds the medium M around the winding unit 22. As a result, tension is further applied to the medium M, and a force that raises the tension bar 55 is generated. As the medium M is wound around the winding unit 22 and the length of the medium M between the tip end of the third support unit 26 and the winding unit 22 decreases, the tension bar 55 positioned in the lower limit position P2 pivots (rises) toward the upper limit position P1 about the pivoting shaft 53. When the tension bar 55 reaches the upper limit position P1, the flag plate 63 pivoted along with the arm 54 is removed from the area between the light emitting unit 65 and the light receiving unit 66 of the upper limit sensor 61, and the signal of "ON" is output from the upper limit sensor 61. Upon receiving the signal of "ON" output from the upper limit sensor 61, the control unit 41 stops the driving of the winding motor 22M. By repeating the operations described above, the tension imparting unit 15 imparts a predetermined tension to the medium M by the tension bar 55 coming into contact with the back surface of the medium M within the range of the upper limit position P1 and the lower limit position P2 and pressing the medium M. Note that in this exemplary embodiment, the winding operation by the winding unit 22 is performed once per plurality of transport operations by the transport mechanism 23.

Next, a configuration example of the detector 17 will be described. The detector 17 is provided in the tension bar 55, and detects the approach (a proximity) that decreases a distance between the tension bar 55 and the medium to a value less than or equal to the distance threshold value. Examples of the detection method of the detector 17 include a contact type and a non-contact type. Next, a configuration example of the detector 17 of a contact type will be described with reference to FIG. 6 to FIG. 8.

Figure 6:
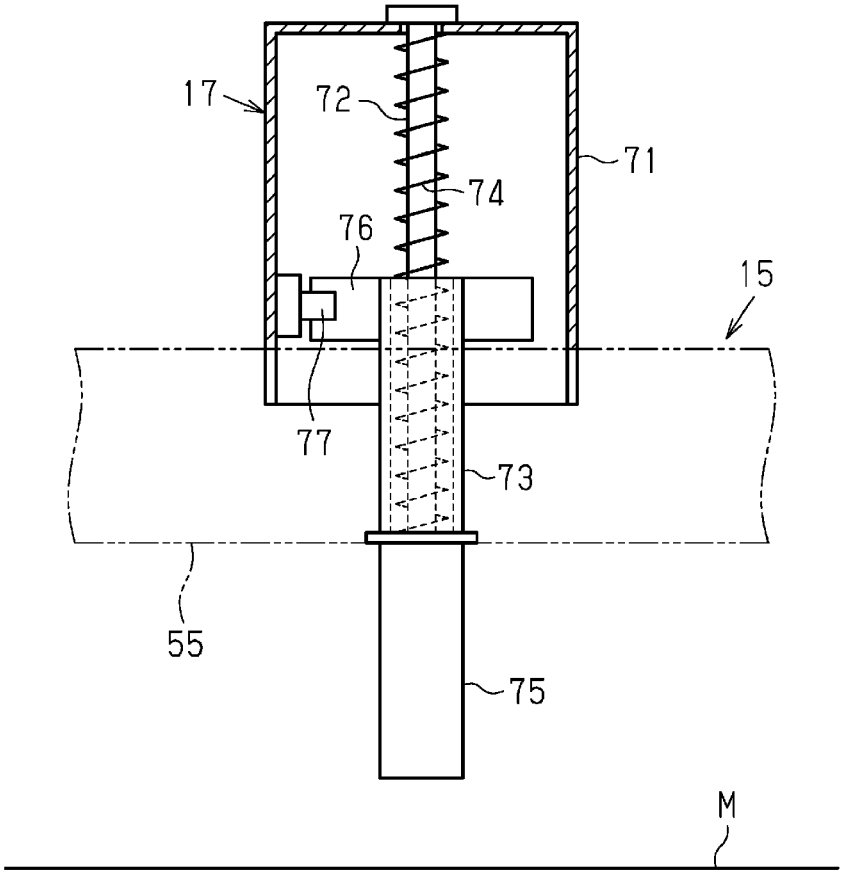
FIG. 6 is a schematic cross-sectional view illustrating a configuration example of a detector.
Figure 7:
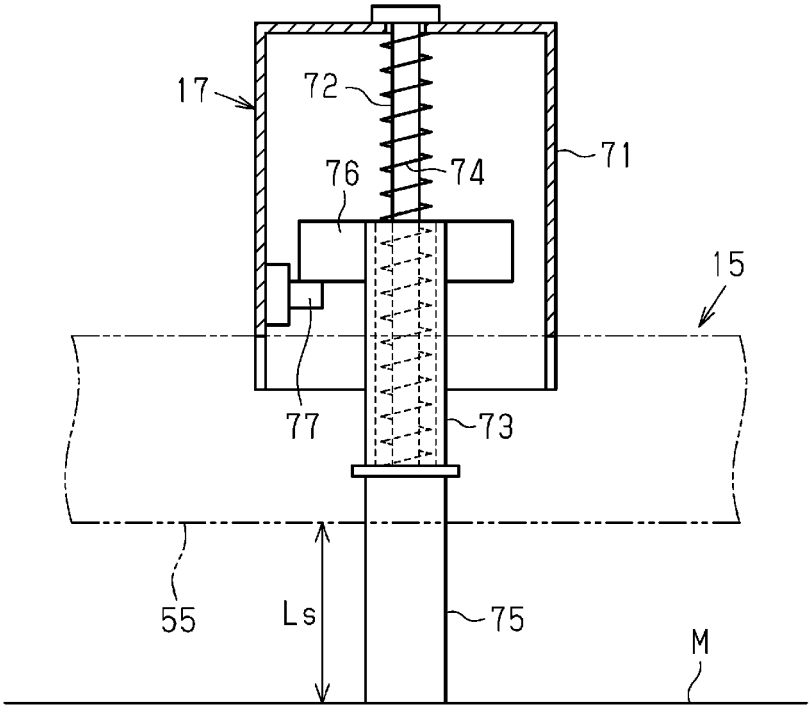
FIG. 7 is a schematic cross-sectional view illustrating a state in which the detector detects a proximity of a medium.
Figure 8:
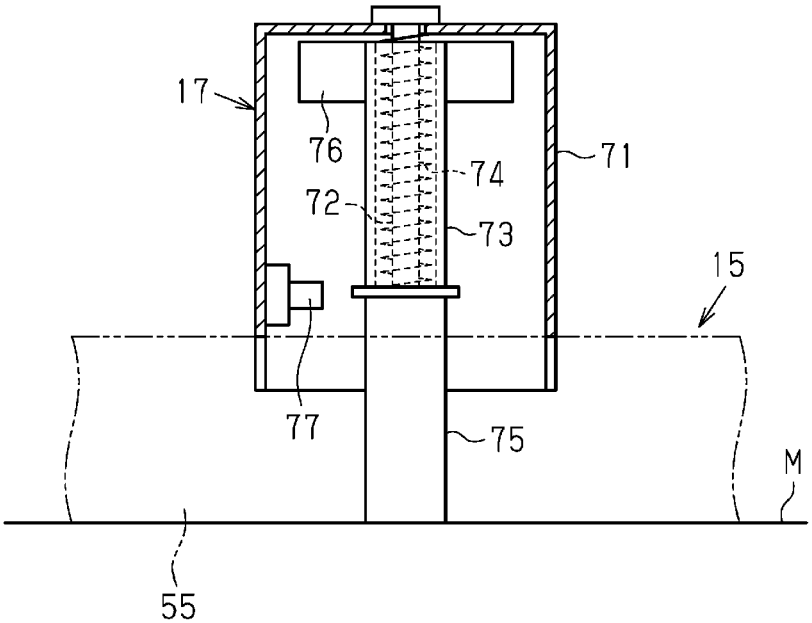
FIG. 8 is a schematic cross-sectional view illustrating the detector when the tension bar collides with the medium.

As illustrated in FIG. 6, the detector 17 of a contact type includes a sensing unit 75 that is movable and capable of sensing the medium M by coming into contact with the medium M. The detector 17 includes a housing 71 having a bottomed tubular shape and fixed to the tension bar 55, a guide shaft 72 fixed to the housing 71, a movable body 73 having a bottomed tubular shape and movable along the guide shaft 72, and a spring 74 configured to bias the movable body 73 in a protruding direction. The sensing unit 75, which is a tip end portion of the movable body 73, is retractable (capable of protruding and retracting) from a surface of the tension bar 55 in a direction toward the medium M (or the medium path) in a portion between the downstream end of the medium support unit 14 and the winding unit 22. Further, a sensor 77 capable of sensing a sensed portion 76 (shielding unit) provided on a base end portion of the movable body 73 is disposed in the housing 71. The sensor 77 senses the sensed unit 76 when the sensing unit 75 is in the protruding position illustrated in FIG. 6, and does not sense the sensed portion 76 when the distance between the tension bar 55 and the medium M is a distance threshold value Ls and the sensing unit 75 is in a sensing position slightly pressed against the protruding position as illustrated in FIG. 7. As illustrated in FIG. 8, in a state where the tension bar 55 is dropped onto the medium M and the entire load of the tension bar 55 is applied to the medium M, the sensing unit 75 is pressed against the medium M and retracted in a state substantially flush with the surface of the tension bar 55. Thus, the tension bar 55 can, without obstruction by the sensing unit 75, apply a biasing force to the medium M by pressing the medium M by a circular arc surface of the tension bar 55. Further, the detector 17 is provided in the tension bar 55, and thus can reliably sense a proximity of the tension bar 55 and the medium M in a distance less than or equal to the distance threshold value Ls without an object blocking the area between the detector 17 and the medium M serving as the sensing target.

The sensor 77 outputs a no detection signal when the sensed portion 76 is sensed, and outputs a detection signal (proximity detection signal) when the sensed portion 76 is not sensed. The sensor 77 is a non-contact sensor formed from an optical sensor such as a photo interrupter, a photo reflector, or the like, for example, but may be a touch-type sensor such as a microswitch.

Figure 9:
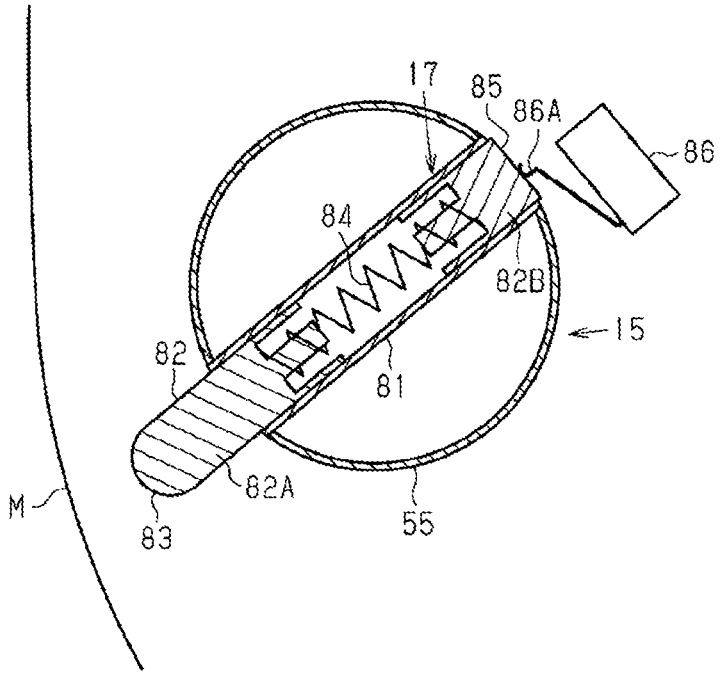
FIG. 9 is a schematic cross-sectional view illustrating another configuration example of the detector.

Next, another configuration example of the detector 17 of a contact type will be described with reference to FIG. 9 and FIG. 10. As illustrated in FIG. 9, the detector 17 is attached to the tension bar 55 with a portion of the detector 17 in a state of extending through the tension bar 55. The detector 17 includes a guide tube 81 having a tubular shape and fixed to the tension bar 55 in a state of extending through the tension bar 55, and a movable body 82 movably provided in an axial direction inside the guide tube 81. The movable body 82 includes a tip end member 82A provided with a sensing unit 83 at a tip end portion, a base end member 82B, and a spring 84 interposed between the tip end member 82A and the base end member 82B. The sensing unit 83 is biased in a direction in which the sensing unit 83 protrudes from the surface of the tension bar 55 by the spring 84, and is retractably provided (capable of protruding and retracting) from the surface of the tension bar 55 toward the path of the medium M. The detector 17 of a contact type of this example is a push type configured to sense a proximity of the tension bar 55 to the medium M by being pushed against the medium M.

As illustrated in FIG. 9, in a state where the tension bar 55 and the medium M are separated by a predetermined distance that is sufficiently longer than the distance threshold value Ls (refer to FIG. 10), the sensing unit 83 is disposed in the protruding position illustrated in FIG. 9 of greatest protrusion from the surface of the tension bar 55. Further, an end portion on an outer side in the axial direction of the base end member 82B serves as a sensed portion 85, and a sensor 86 capable of sensing the sensed portion 85 is disposed, in a position facing the sensed portion 85, in a state of being fixed to the tension bar 55 via a bracket (not illustrated). The sensor 86 does not sense the sensed portion 85 when the sensing unit 83 is in the protruding position illustrated in FIG. 9, and is disposed in a position allowing sensing of the sensed portion 85 when the distance between the tension bar 55 and the medium M is the distance threshold value Ls and the sensing unit 83 is slightly pressed against the medium M and slightly displaced to the outer side. FIG. 9 illustrates an example in which the sensor 86 is a microswitch, and a sensing lever 86A is in a state of being contact with the sensed portion 85 at an angle of an off state. Then, the sensing unit 83 pressed against the medium M slightly retracts to the position indicated by the solid line in FIG. 10 when the distance between the tension bar 55 and the medium M reaches the distance threshold value Ls, the sensed portion 85 coupled via the spring 84 is displaced slightly to the outer side, and the sensing lever 86A is pressed as illustrated in FIG. 10, turning the sensor 86 on. Subsequently, as illustrated by the double dot chain line in FIG. 10, when the tension bar 55 is dropped onto the medium M and the entire load of the tension bar 55 is applied to the medium M, the sensing unit 83 pressed against the medium M retracts into the tension bar 55 until the sensing unit 83 is in a state of being substantially flush with the surface of the tension bar 55. Thus, the medium M can be biased by the circular arc surface of the tension bar 55 without the sensing unit 83 being an obstruction, and the sensing unit 83 never damages the medium M. Further, the spring 84 is compressed in the process of the movable body 82 moving from the protruding position indicated by the solid line in FIG. 9 to the retracted position indicated by the double dot chain line in FIG. 10, a displacement amount of the base end member 82B is minimized compared to a displacement amount of the tip member 82A, and the force applied to the sensor 86 from the sensed portion 85 is kept at a constant value or less even when a total load of the tension bar 55 is applied to the medium M.

Figure 10:
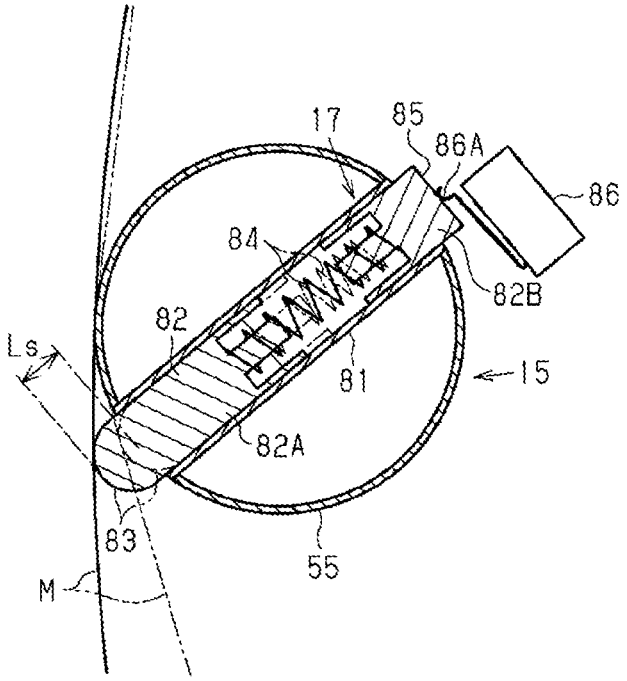
FIG. 10 is a schematic cross-sectional view illustrating a state in which the detector detects the proximity of the medium.

The sensor 86 outputs a no detection signal when the sensed portion 85 is not sensed as illustrated in FIG. 9, and outputs a detection signal when the sensed portion 85 is sensed as illustrated in FIG. 10. As long as the sensor 86 can sense the sensed portion 85, the sensor 86 is not limited to a contact type and may be a non-contact type. For example, in a case where the sensor 86 of a non-contact type is used, an optical sensor such as a photo interrupter, a photo reflector, or the like may be used in the same manner as in the example of FIG. 6.

Next, a configuration example of the detector 17 of a non-contact type will be described with reference to FIG. 11 and FIG. 12. The detector 17 of a non-contact type includes a proximity sensor 87 built into the tension bar 55 as illustrated in FIG. 11, and a distance sensor 88 built into the tension bar 55 as illustrated in FIG. 12.

Figure 11:
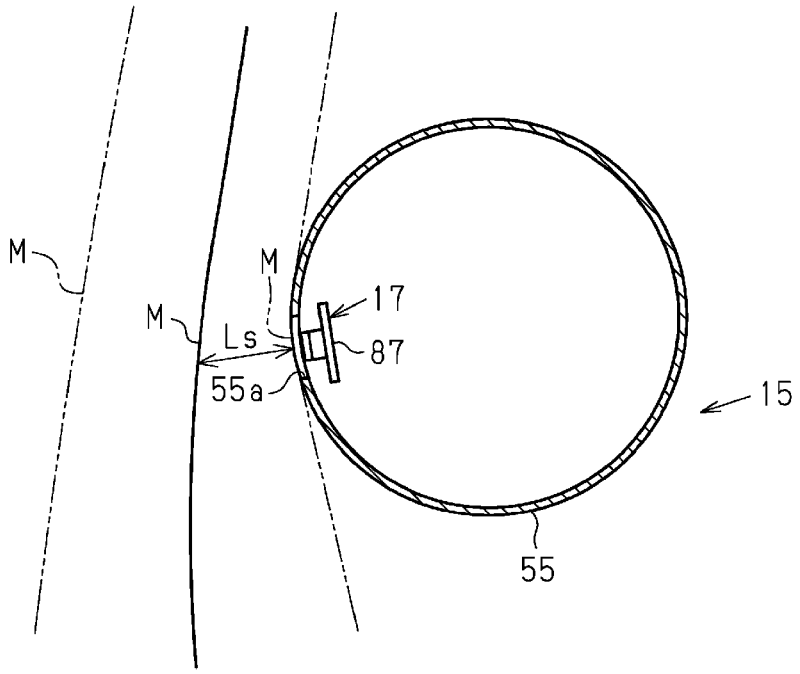
FIG. 11 is a schematic cross-sectional view illustrating a configuration example of the detector that is different from that in FIG. 10.

The detector 17 illustrated in FIG. 11 includes a window portion 55*a* that opens to a surface portion of the tension bar 55, and the proximity sensor 87 built into the tension bar 55 in a state facing the window portion 55*a*. The window portion 55*a* is provided in a portion of contact with the medium M in the surface portion of the tension bar 55, and the proximity sensor 87 detects the medium M from the window portion 55*a*. When the medium M is in the position indicated by the double dot chain line on the left side in FIG. 11 in which the distance between the tension bar 55 and the medium M sufficiently exceeds the distance threshold value Ls, the proximity sensor 87 is unable to sense the medium M and outputs a no detection signal. Further, when the medium M is in the position indicated by the solid line in FIG. 11 in which the distance between the tension bar 55 and the medium M is the distance threshold value Ls, the proximity sensor 87 senses the medium M and outputs a detection signal. Then, in a state where the tension bar 55 is dropped onto the medium M and the entire load of the tension bar 55 is applied to the medium M, the medium M is pressed against the surface of the tension bar 55 in the position indicated by the double dot chain line on the right side in FIG. 11. At this time as well, the distance between the tension bar 55 and the medium M is the distance threshold value Ls or less, and thus the proximity sensor 87 outputs a detection signal. Further, because the proximity sensor 87 is built into the tension bar 55, without the proximity sensor 87 being an obstruction, the tension bar 55 can bias the medium M with the circular arc surface. Note that the proximity sensor 87 may be any type, such as an inductive type, a magnetic type, or a capacitive type. An inductive type proximity sensor generates a high-frequency magnetic field from a detection coil, and detects a change in an impedance of the detection coil due to an induced current (eddy current) induced by electromagnetic induction. A magnetic type proximity sensor senses a proximity of a magnet applied to the contact lever with a detector provided with a lead of a magnetic body. A capacitive type proximity sensor provides an electric field and senses, with oscillation or the like of capacitance, a degree of polarization by electrostatic induction caused by a proximity object.

Figure 12:
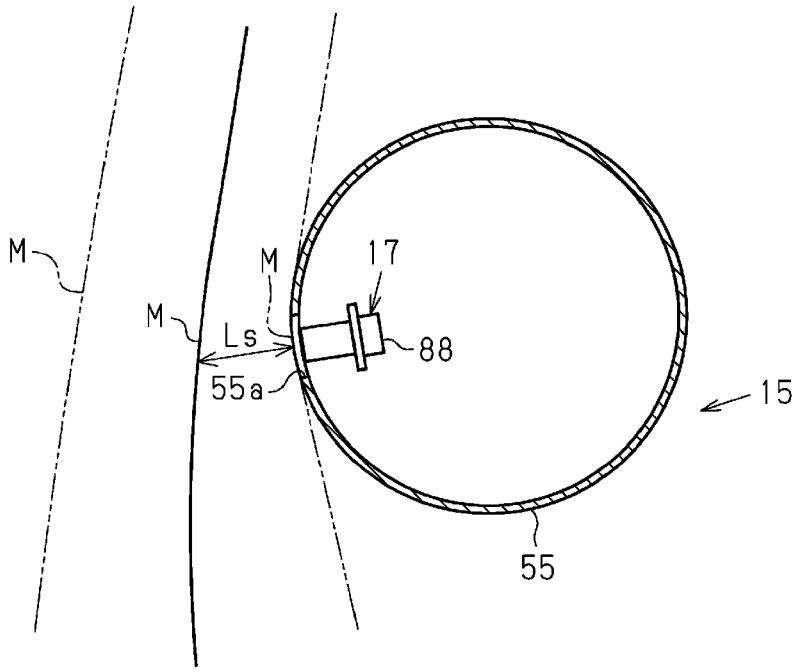
FIG. 12 is a schematic cross-sectional view illustrating a configuration example of the detector that is different from that in FIG. 11.

Further, the detector 17 illustrated in FIG. 12 includes the same window portion 55*a* as in FIG. 11, which opens to the surface portion of the tension bar 55, and the distance sensor 88 built into the tension bar 55 in a state facing the window portion 55*a*. The distance sensor 88 detects the distance to the medium M through the window portion 55*a*. When the medium M is in the position indicated by the double dot chain line on the left side in FIG. 11 in which the distance between the tension bar 55 and the medium M sufficiently exceeds the distance threshold value Ls, the detected distance to the medium M exceeds the distance threshold value Ls and thus the distance sensor 88 outputs the no detection signal. Further, when the medium M is in the position indicated by the solid line in FIG. 12 in which the distance between the tension bar 55 and the medium M is the distance threshold value Ls, the detected distance to the medium M is the distance threshold value Ls and thus the distance sensor 88 outputs the detection signal. Then, in a state where the tension bar 55 is dropped onto the medium M and the entire load of the tension bar 55 is applied to the medium M, the medium M is pressed against the surface of the tension bar 55 as indicated by the double dot chain line on the right side in FIG. 12. At this time as well, the distance between the tension bar 55 and the medium M is the distance threshold value Ls or less, and thus the distance sensor 88 outputs the detection signal. Further, because the distance sensor 88 is built into the tension bar 55, without the distance sensor 88 being an obstruction, the tension bar 55 can bias the medium M with the circular arc surface. Note that the distance sensor 88 may be any of an ultrasonic sensor, a radio wave type sensor, or a pneumatic type sensor. For example, an ultrasonic sensor detects distance by emitting ultrasonic waves, receiving the ultrasonic waves reflected from a target object, and measuring the distance from the time from emission to receipt.

Next, a configuration example of the biasing force adjustment unit 18 will be described with reference to FIG. 13 to FIG. 20. Here, configuration examples of the biasing force adjustment unit 18 include a drive source method (such as in FIG. 13) that directly adjusts the biasing force by a driving force of a drive source such as an electric motor, a frictional load method (FIG. 18, FIG. 19) that adjusts the biasing force by using frictional resistance, a center-of-gravity shift method (FIG. 20) that adjusts the biasing force by using the center-of-gravity shift, and the like. The biasing force adjustment unit 18 also functions as a braking force generating unit 19 that generates a braking force to adjust the biasing force by applying a load to the tension imparting unit 15. In this case, the biasing force adjustment unit 18 adjusts the biasing force of the tension bar 55 to a small value compared to the biasing force of a case without performing an adjustment. The load applied to the tension imparting unit 15 by the biasing force adjustment unit 18 (braking force generating unit 19) is by any one of a driving force of a drive source, a frictional load, a viscous load, an elastic load, and a center-of-gravity shift of the tension imparting unit 15. The biasing force adjustment units 18 (the braking force generating units 19) of the drive source method, the frictional load method, and the center-of-gravity shift method indicated below each include a drive source, and are configured to be capable of adjusting the braking force generated by the tension imparting unit 15 by the control of the drive source. Next, a configuration example of the biasing force adjustment unit 18 of the drive source method will be described with reference to FIG. 13 to FIG. 19.

Figure 13:
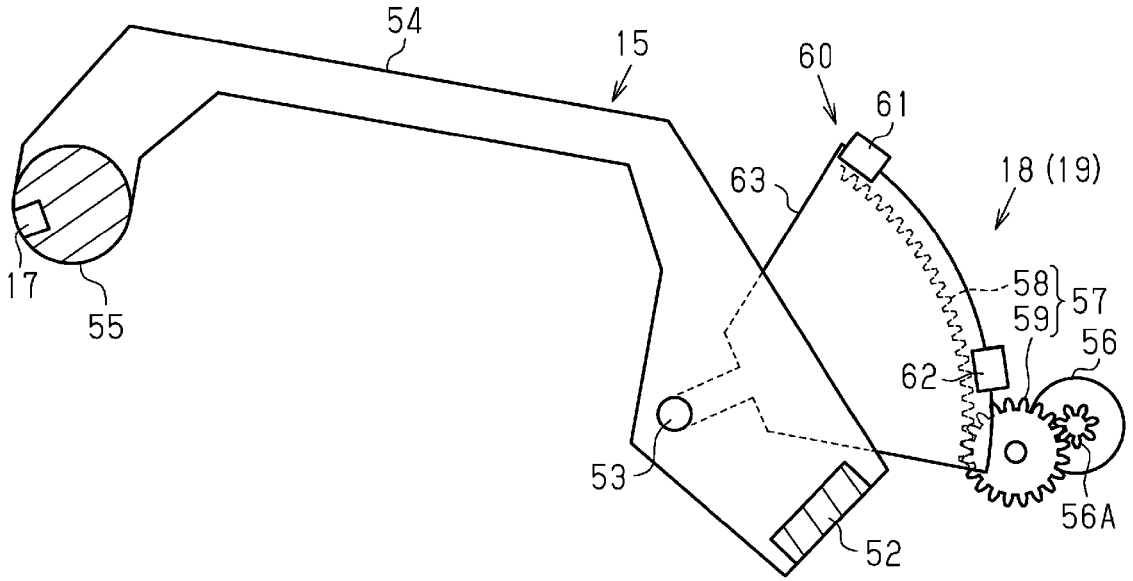
FIG. 13 is a schematic side view illustrating the tension imparting unit and a biasing force adjustment unit.

As illustrated in FIG. 13, the biasing force adjustment unit 18 includes an electric motor 56 serving as an example of the drive source, and a transmission gear mechanism 57 meshing with a drive gear 56A capable of rotating together with an output shaft of the electric motor 56 and configured to transmit the power of the rotation to the pivoting shaft 53. The transmission gear mechanism 57 includes a fan-shaped gear 58 (sector gear) disposed in one of the arms 54 to be capable of pivoting about the pivoting shaft 53, and a gear mechanism 59 interposed between the drive gear 56A and the fan-shaped gear 58. Note that while FIG. 13 illustrates an example where the gear mechanism 59 is configured of one gear, a configuration example in which a plurality of gears are provided (described later) is also possible.

A rotation force output from the electric motor 56 is transmitted, via the drive gear 56A and the gear mechanism 59 to the fan-shaped gear 58, and when the pivoting shaft 53, together with the fan-shaped gear 58, is pivoted, the pair of arms 54 are pivoted. As a result, the biasing force (rotation force) in the pivoting direction is imparted to the tension bar 55 supported by the pair of arms 54. When the electric motor 56 is controlled to be driven by the control unit 41, the biasing force adjustment unit 18 can adjust the biasing force imparted by the tension bar 55 to the medium M.

Thus, the biasing force adjustment unit 18 adjusts the biasing force caused by the dead weight (gravity) of the tension bar 55 by the power of the electric motor 56. The biasing force adjustment unit 18 controls a driving speed of the electric motor 56 by the control unit 41 to adjust a pivoting speed of the tension bar 55, making it possible to adjust a drop height of the tension bar 55 from the position at the start of dropping to a drop end position onto the medium M, and a drop speed of the tension bar 55 when the tension bar 55 is dropped onto the medium M. The biasing force adjustment unit 18 of this example functions as the braking force generating unit 19 that generates a braking force that acts as a force in a direction (upward in the pivoting direction) opposite to the force in the dropping direction (downward in the pivoting direction) due to the dead weight of the tension bar 55 during the drop process of the tension bar 55.

Figure 14:
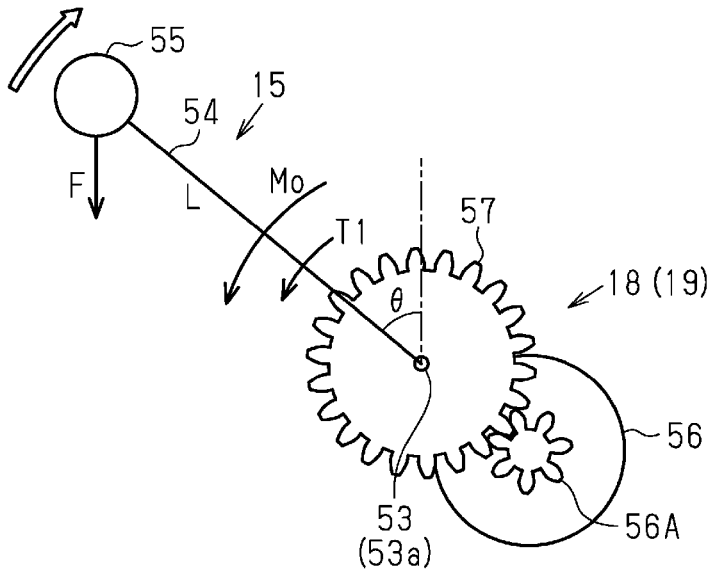
FIG. 14 is a schematic view for explaining an operation of the biasing force adjustment unit during winding.
Figure 15:
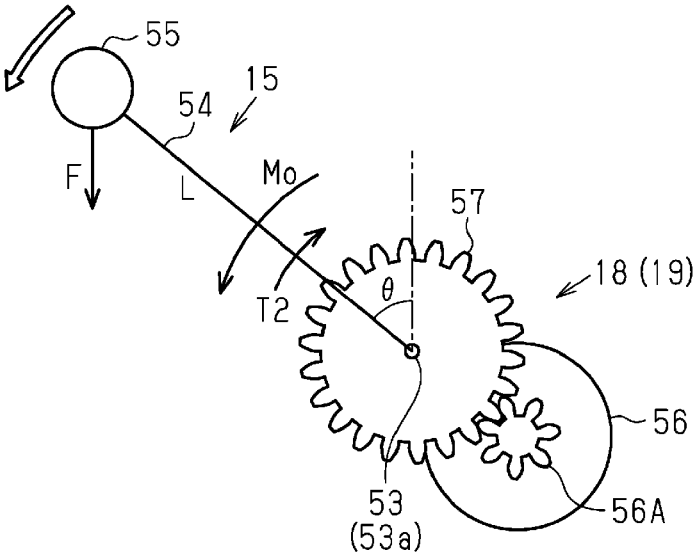
FIG. 15 is a schematic view for explaining an operation of the biasing force adjustment unit during transport.
Figure 16:
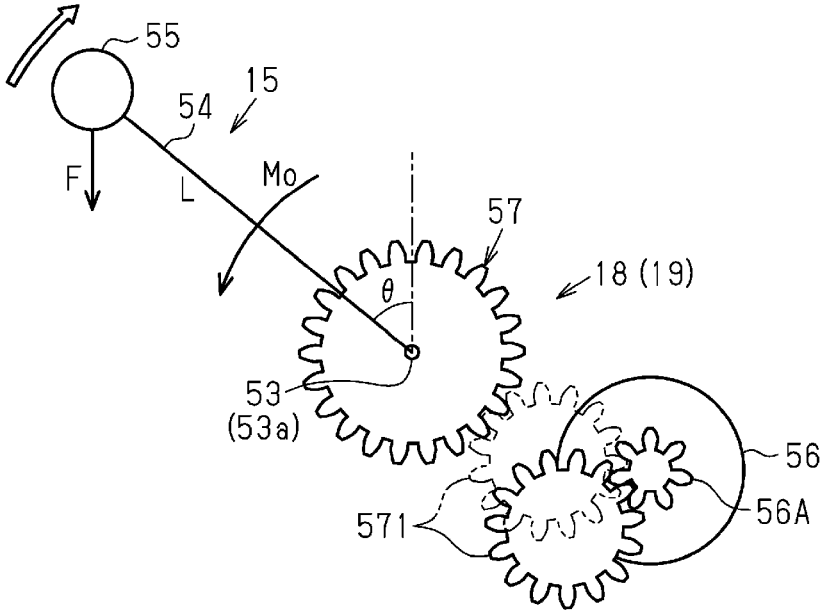
FIG. 16 is a schematic view for explaining an operation of a biasing force adjustment unit different from that in FIG. 15 during winding.
Figure 17:
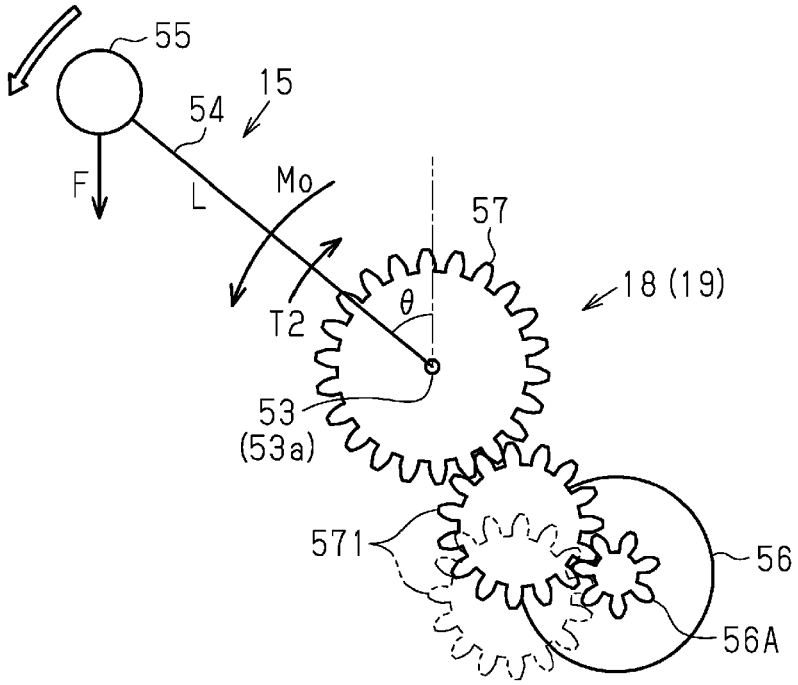
FIG. 17 is a schematic view for explaining an operation of the same biasing force adjustment unit during transport.

Here, the next two configuration examples illustrated in FIG. 14 to FIG. 17 are illustrated as transmission gear mechanisms 57. The first transmission gear mechanism 57 illustrated in FIG. 14 and FIG. 15 is a configuration example in which the electric motor 56 and the tension bar 55 are continuously coupled in a power transmittable manner. The second transmission gear mechanism 57 illustrated in FIG. 16 and FIG. 17 constitutes a planetary gear mechanism including a planet gear 571, and is a configuration example in which the planet gear 571 is detachable from a power transmission path according to the pivoting direction of the tension bar 55. Note that FIG. 14 and FIG. 16 illustrate an operation during the winding of the tension bar 55, and FIG. 15 and FIG. 17 illustrate an operation during the dropping of the tension bar 55, respectively.

In the biasing force adjustment unit 18 illustrated in FIG. 14 and FIG. 15, the power transmission path is continuously coupled via the transmission gear mechanism 57, and therefore a detent torque and an inertia torque of the electric motor 56 are applied both during dropping and during winding, requiring tension correction by a motor torque for each. However, torque control can be carried out by the control of the electric motor 56 even during winding, making it possible to use the mechanism as a tension variable mechanism when the load of the tension bar 55 is to be corrected with the medium M or the like having a heavy weight per unit length.

The biasing force adjustment unit 18 illustrated in FIG. 16 and FIG. 17 includes the planetary gear 571 detachable from the power transmission path, and thus the planetary gear 571 is detached to disconnect the power transmission path during winding. As a result, the tension cannot be changed during winding. However, because the power transmission path is disconnected during winding and the biasing force of the tension bar 55 is based on only the dead weight of the tension bar 55, the advantage of being able to tightly control load fluctuation of the tension bar 55, which has a significant impact on winding deviation of the medium M in the winding unit 22, and thus suppress winding deviation of the medium M is achieved.

Next, the biasing force of the tension bar 55 in the tension imparting unit 15 illustrated in FIG. 14 to FIG. 17 will be described. Here, in FIG. 14 to FIG. 17, Mo denotes a moment of the tension imparting unit 15, T1 denotes a motor torque of the electric motor 56, L denotes a pivoting radius of the tension bar 55, and e denotes an angle formed by a straight line connecting the tension bar 55 and a pivot fulcrum 53*a* with respect to a vertical line. The motor torque T1 is defined as positive in the pivoting direction during the dropping of the tension bar 55, and negative in the pivoting direction during winding of the tension bar 55.

In the tension imparting unit 15 illustrated in FIG. 14, the force F in the gravitational direction acting on the tension bar 55 during winding is $F=(Mo+T1)/(L\cdot\sin\theta)$. Of this force F, "$T1/(L\cdot\sin\theta)$" corresponds to the force of the adjustment caused by the motor torque of the electric motor 56, and the tension during winding can be changed by adjusting the force of this adjustment. Further, in the tension imparting unit 15 illustrated in FIG. 15, the force F in the gravitational direction acting on the tension bar 55 during dropping is $F=(Mo-T2)/(L\cdot\sin\theta)$. Of this force F, "$-T2/(L\cdot\sin\theta)$" corresponds to the braking force caused by the motor torque of the electric motor 56.

Further, in the tension imparting unit 15 illustrated in FIG. 16, the force F in the gravitational direction acting on the tension bar 55 during winding is $F=Mo/(L\cdot\sin\theta)$ due to disconnection of the power transmission path. Further, in the tension imparting unit 15 illustrated in FIG. 17, the force F in the gravitational direction acting on the tension bar 55 during dropping is $F=(Mo-T2)/(L\cdot\sin\theta)$. Of this force F, "$-T2/(L\cdot\sin\theta)$" is the braking force caused by the motor torque of the electric motor 56. These biasing force adjustment units 18 function as braking force generating units 19 that generate a braking force at least during the dropping of the tension bar 55.

Figure 18:
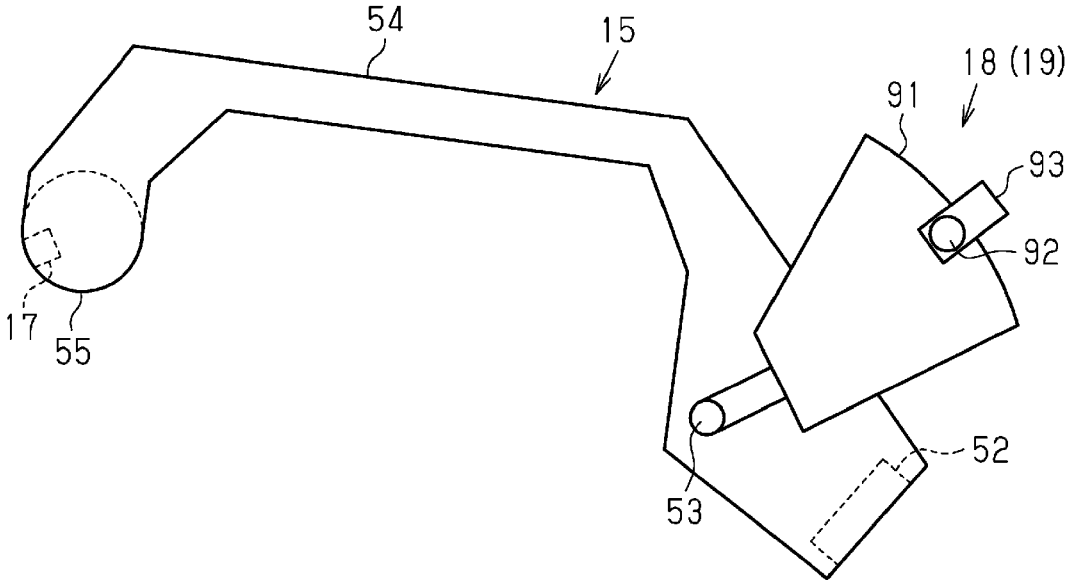
FIG. 18 is a schematic side view illustrating the tension imparting unit and the biasing force adjustment unit of another configuration example.

Next, another configuration example of the biasing force adjustment unit 18 will be described with reference to FIG. 18 and FIG. 19. The biasing force adjustment unit 18 illustrated in FIG. 18 and FIG. 19 adjusts the biasing force by applying a frictional load on the tension imparting unit 15. The frictional force generated by applying the frictional load acts in a direction opposite to the pivoting direction (biasing direction) of the tension bar 55, and thus acts as a braking force of the tension bar 55. In this regard, the biasing force adjustment unit 18 also functions as a braking force generating unit 19 using the frictional force as a braking force. The biasing force adjustment unit 18 includes a braked member 91, which is fixed to the base end portion of the arm 54 and capable of pivoting with the pivoting shaft 53, a frictional member 92 capable of pressing on the braked member 91, and an electric motor 93 configured to move the frictional member 92 from a separation position being away from the braked member 91 and a brake position of pressing on the braked member 91. In the example illustrated in FIG. 18, the frictional member 92 is displaced in a direction parallel to the axis of the pivoting shaft 53 by the power of the electric motor 93, and the frictional force generated when the side surface (braked surface) of the braked member 91 is pressed at the braking position, is the braking force of the tension bar 55.

Figure 19:
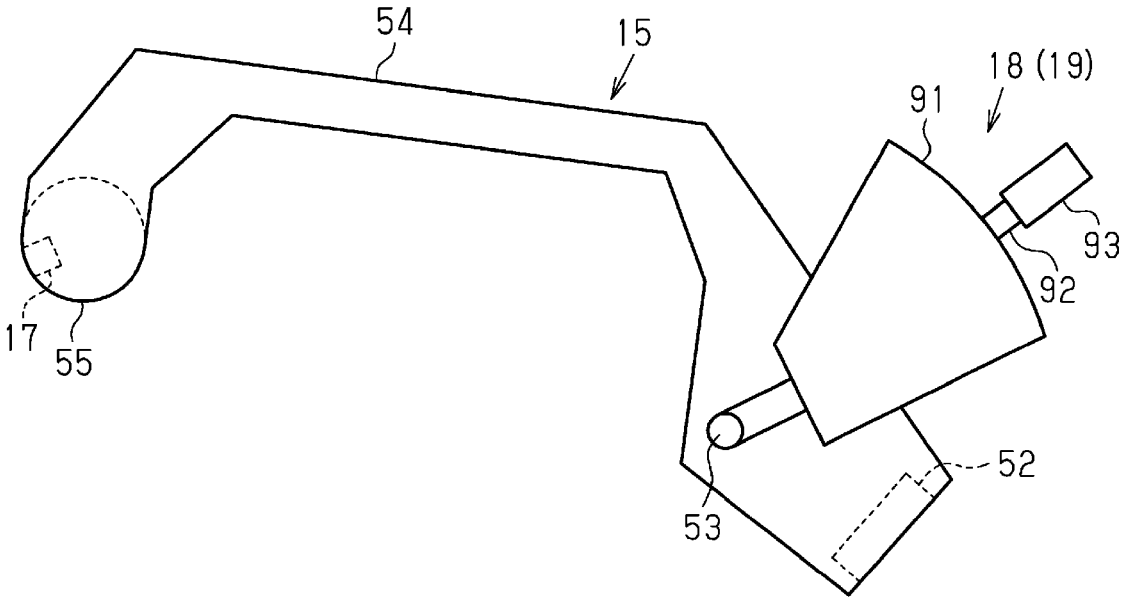
FIG. 19 is a schematic side view illustrating the biasing force adjustment unit of a configuration example different from that in FIG. 18.

Additionally, in the example illustrated in FIG. 19, the frictional member 92 is displaced in a direction orthogonal to the axis of the pivoting shaft 53 (radial direction) by the power of the electric motor 93, and the frictional force generated when the outer peripheral surface (braked surface) of the braked member 91 is pressed at the braking position, is the braking force of the tension bar 55. Note that the frictional member 92 may be configured to press the arm 54 or the flag plate 63. Furthermore, the pressing direction of the friction member 92 is not limited to the axial direction and the radial direction of the pivoting shaft 53, and can be selected as appropriate as long as a braking force can be generated on the tension bar 55.

Additionally, the load applied to the tension imparting unit 15 may be a viscous load. In other words, the biasing force adjustment unit 18 (braking force generating unit 19) may be configured to apply a brake load to the tension imparting unit 15 by a viscous resistance mechanism that is directly or removably coupled to the pivoting shaft 53 of the tension bar 55. For example, a rotary damper may be used as the viscous resistance mechanism to releasably attach the rotary damper to the pivoting shaft 53 of the tension bar 55 directly or via an electromagnetic clutch. In this case, the electromagnetic clutch is controlled by the control unit 41.

Additionally, the load applied to the tension imparting unit 15 may be an elastic load. In other words, the biasing force adjustment unit 18 (braking force generating unit 19) may be configured to apply a brake load to the tension imparting unit 15 by an elastic body that is directly or removably coupled to the pivoting shaft 53 of the tension bar 55. For example, the biasing force adjustment unit 18 includes a configuration of a coupling member disposed in a state of being rotatable at a position coaxial with the pivoting shaft 53, an electromagnetic clutch interposed between the pivoting shaft 53 and the coupling member, and a torsion coil spring that biases the coupling member in the pivoting direction. In this case, the electromagnetic clutch is controlled by the control unit 41.

Next, another configuration example of the biasing force adjustment unit 18 will be described with reference to FIG. 20. The biasing force adjustment unit 18 illustrated in FIG. 20 adjusts the biasing force of the tension bar 55 by shifting the center of gravity of the tension imparting unit 15. By shifting the center of gravity of the tension imparting unit 15 to generate the braking force to the tension bar 55, the biasing force adjustment unit 18 also functions as the braking force generating unit 19. The biasing force adjustment unit 18 includes a center of gravity shift mechanism 100 that temporarily moves the center of gravity of the tension imparting unit 15 in a direction in which the rotational torque of the tension bar 55 decreases.

The center of gravity shift mechanism 100 includes a weight portion 101 configured to move the center of gravity of the tension imparting unit 15 and a movement mechanism 102 configured to move the weight portion 101 in a direction in which the center of gravity of the tension imparting unit 15 can be shifted. The movement mechanism 102 employs, for example, a belt moving method, and includes a pair of pulleys 103 and an endless belt 104 wound around the pair of pulleys 103. The weight portion 101 is fixed to a portion of the belt 104. The output shaft of the electric motor 105 is coupled to one pulley 103 via a gear mechanism 106 in a power transmittable manner. The forward and reversing drive of the electric motor 105 causes the weight portion 101 to move along the longitudinal direction of the arm 54, making the center of gravity of the tension imparting unit 15 to shift. When the electric motor 105 is driven forward, the weight portion 101 moves toward the tension bar 55 side, and the center of gravity of the tension imparting unit 15 shifts toward the tension bar 55 side. In this case, the delay in start of the movement of the tension bar 55 with respect to the medium M can be reduced. On the other hand, when the electric motor 105 is reversely driven, the weight portion 101 moves toward the pivoting shaft 53 side, and the center of gravity of the tension imparting unit 15 shifts toward the pivoting shaft 53 side. For example, when the electric motor 105 is reversely driven during dropping of the tension bar 55, the weight portion 101 moves toward the pivoting shaft 53 side, and the center of gravity of the tension imparting unit 15 shifts toward the pivoting shaft 53 side. Thus, a braking force is generated in the tension bar 55. Furthermore, at the time of winding, the electric motor 105 is driven and controlled to adjust the position of the weight portion 101, which enables tension adjustment. Note that, in addition to the configuration example described above, the center of gravity shift mechanism 100 may be configured to shift the center of gravity of the tension bar 55 in a direction in which the rotational torque decreases with a variable rotation fulcrum position of the tension bar 55.

Figure 21:
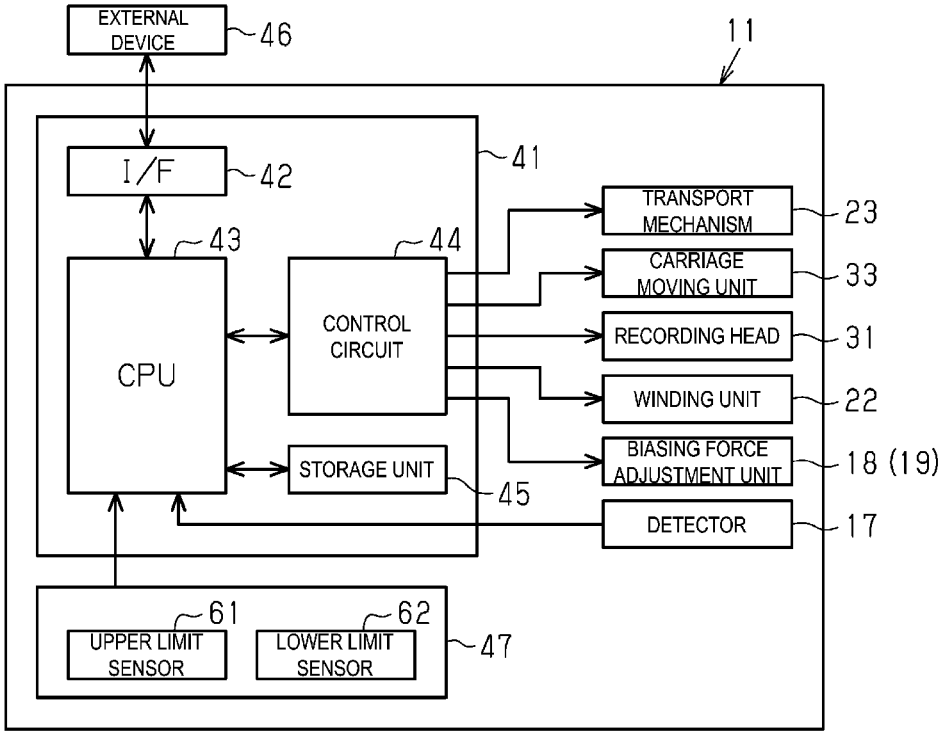
FIG. 21 is a block diagram illustrating an electrical configuration of a printing device.

Next, an electrical configuration of the printing device 11 will be described with reference to FIG. 21. The control unit 41 is a control unit configured to control the printing device 11. The control unit 41 is configured with and includes a control circuit 44, an interface (I/F) 42, a Central Processing Unit (CPU) 43, and a storage unit 45. The interface 42 is configured for receiving and transmitting data between an external device 46, such as a computer and a digital camera configured to handle an image, and the printing device 11. The CPU 43 is an operation processing device configured to perform processing of an input signal from a detector group 47 and control of the entire printing device 11.

Based on print data received from the external device 46, with the control circuit 44, the CPU 43 controls the transport mechanism 23 configured to transport the medium M in the transport direction, the carriage moving unit 33 configured to move the carriage 32 in the direction intersecting the transport direction, the recording head 31 configured to eject ink onto the medium M, the winding unit 22 configured to wind the medium M, and the respective devices which are not illustrated.

The storage unit 45 is configured to ensure a region for storing programs of the CPU 43, a working region, and the like, and includes a storage element such as a Random Access Memory (RAM), and an Electrically Erasable Programmable Read Only Memory (EEPROM). The detector group 47 includes the upper limit sensor 61 configured to detect the upper limit position P1 of the tension bar 55 and the lower limit sensor 62 configured to detect the lower limit position P2 of the tension bar 55. Further, the detector group 47 includes a rotation detector configured to detect a rotation of the pair of transporting rollers 23*a*. Note that in FIG. 21, the feeding unit 21 is omitted, but the control unit 41 drives and controls the feed motor (not illustrated) constituting the feeding unit 21.

Figure 24:
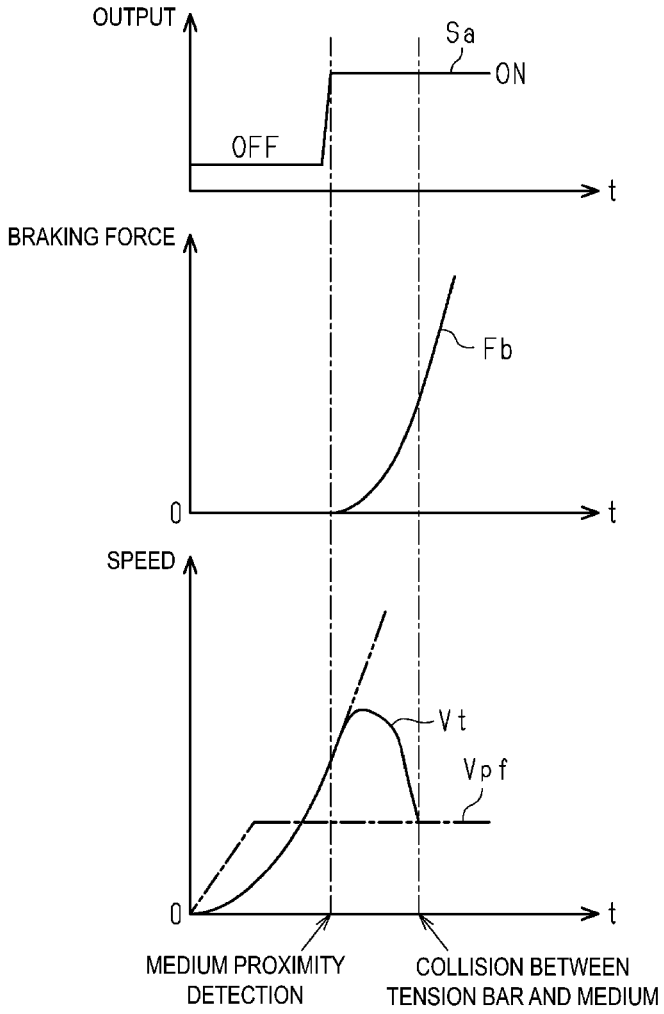
FIG. 24 is a timing chart illustrating biasing force adjustment control of the tension bar.

Further, the CPU 43 determines whether the tension bar 55 and the medium M are proximity to each other in a distance equal to or smaller than the distance threshold value Ls, based on the detection signal Sa input from the detector 17 (see FIG. 24). For example, after the transport mechanism 23 starts the transport operation, the CPU 43 executes the program for biasing force adjustment control when the detection signal Sa from the detector 17 switches from an "ON" in which the tension bar 55 is held in contact with the tension bar 55 to an "OFF" in which the distance between the two exceeds the distance threshold value Ls. Then, during the execution of the biasing force adjustment control, the CPU 43 drives the biasing force adjustment unit 18 (braking force generating unit 19) when the detection signal Sa from the detector 17 switches from the "OFF" in which the distance between the tension bar 55 and the medium M exceeds the distance threshold value Ls to the "ON" in which the distance is equal to or smaller than the distance threshold value Ls. Then, through calculation or with reference to table data, the CPU 43 acquires the braking force required to cause a relative speed to fall within a predetermined range, the relative speed of the tension bar 55 with respect to the medium M at which the tension bar 55 is brought into contact with the M being temporarily separated from each other. The CPU 43 drives the electric motors 56, 93, and 105 constituting the biasing force adjustment unit 18 at a motor torque capable of generating the acquired braking force.

In this case, the braking force may be changed in accordance with the position (movement start position) of the tension bar 55 when the tension bar 55 starts moving in the biasing direction (downward pivoting direction). Here, the relative speed at which the tension bar 55 that starts moving from the movement start position is brought into contact again with the medium, which was temporarily separated, (for example, the collision speed) is changed in accordance with the above-mentioned position (movement start position) of the tension bar 55. Thus, the braking force that can cause the relative speed of the tension bar 55 and the medium M, at which the tension bar 55 and the medium M are brought into contact with each other again to fall within a predetermined range, is obtained in accordance with the movement start position of the tension bar 55. Based on the movement start position of the tension bar 55, the CPU 43 acquires a motor command value capable of obtaining the required braking force through calculation or with reference to table data. The CPU 43 commands the acquired motor command value to the control circuit 44, and drives and controls the electric motors 56, 93, and 105. Note that the motor command value obtained by the CPU 43 is obtained as a value corresponding to a difference in the method of the biasing force adjustment unit 18 (braking force generating unit 19), that is, the difference in the method such as the drive source method (FIG. 13 and the like), the frictional load method (FIG. 18 and FIG. 19), and the center of gravity shift method (FIG. 20).

Figure 22:
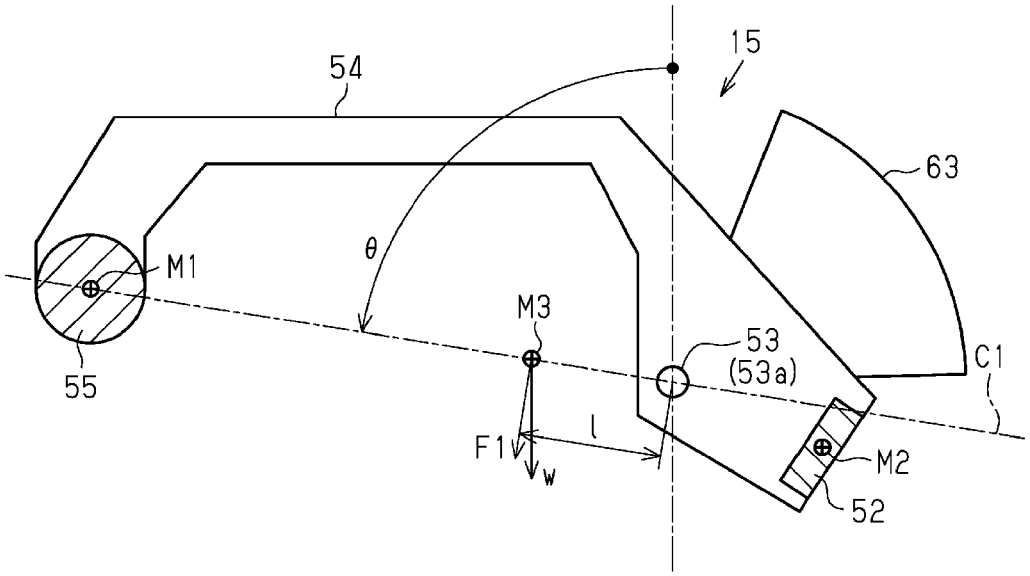
FIG. 22 is a side cross-sectional view illustrating a configuration of the tension imparting unit.

Next, the position of the center of gravity of the tension imparting unit 15 will be described with reference to FIG. 22. Note that in FIG. 22, a center of gravity position M1 of the tension bar 55, a center of gravity position M2 of the counter weight 52, and a center of gravity position M3 of the entire tension imparting unit 15 are illustrated. As illustrated in FIG. 22, the center of gravity position M2 of the counter weight 52 is provided below a straight line C1 in the vertical direction, which connects the pivoting fulcrum 53*a* of the arm 54 and the center of gravity position M1 of the tension bar 55. As a result, even in a shape in which the arm 54 is convexly curved upward in the vertical direction, the center of gravity position M3 of the entire tension imparting unit 15 can be brought close to the straight line C1 connecting the pivoting fulcrum 53*a* and the center of gravity position M1 of the tension bar 55. Further, the center of gravity position M2 of the counter weight 52 is provided on an opposite side to the center of gravity position M1 of the tension bar 55 across the vertical line passing through the pivoting fulcrum 53*a*. Thus, the center of gravity position M3 of the entire tension imparting unit 15 approaches the pivoting fulcrum 53*a* side, and a distance 1 between the center of gravity position M3 and the pivoting fulcrum 53*a* is shortened.

Next, a pivoting range in which the tension bar 55 can impart tension to the medium M will be described with reference to FIG. 22 and FIG. 23. Note that in the following description, in FIG. 22, an angle θ is formed by the straight line C1 connecting the pivoting fulcrum 53*a* and the center of gravity position M1 of the tension bar 55 and the vertical line, and the angle θ is referred to as an inclination angle of the arm 54.

Figure 23:
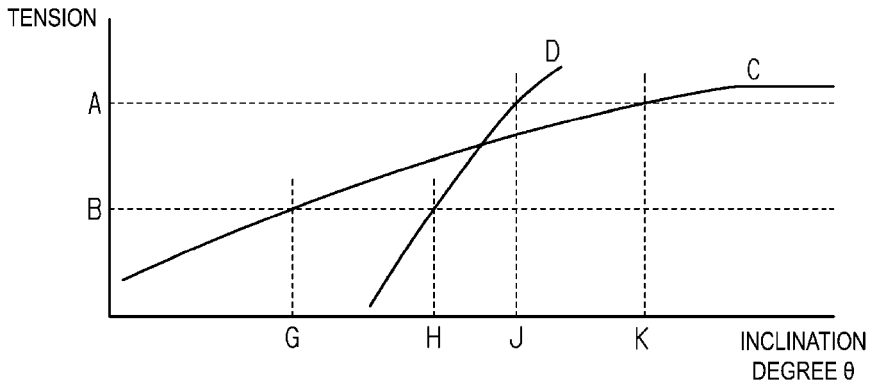
FIG. 23 is a graph illustrating a relationship between an inclination angle of an arm and the tension of the medium.

The horizontal axis in FIG. 23 represents the inclination angle θ of the arm 54, and the longitudinal axis represents the tension imparted to the medium M when the tension bar 55 positioned at the inclination angle θ presses on the medium M. The dashed line A in the diagram represents a predetermined upper limit tension to be imparted to the medium M, and the dashed line B represents a predetermined lower limit tension to be imparted to the medium M. The curve C represents the tension imparted to the medium M by the tension imparting unit 15 of the present exemplary embodiment, which includes the counter weight 52, and the curve D represents the tension imparted to the medium M by the tension imparting unit of Comparative Example, which does not include the counter weight 52.

The load F for pressing the medium M to apply tension to the medium M is expressed by the following expression where: "w" represents the mass of the tension imparting unit 15; and "l" represents the distance between the pivoting fulcrum 53*a* and the center of gravity position M3 of the tension imparting unit 15 (see FIG. 22).

$$F = w \cdot l \cdot \sin\theta \quad \text{(Expression 1)}$$

From Expression 1, it can be seen that the load F fluctuates depending on the inclination angle θ, and that the amount of fluctuation of the load F decreases in proportion to the distance 1 when the distance 1 decreases. As a result, the fluctuation in the tension imparted to the medium M is also reduced. The distance 1 between the pivoting fulcrum 53*a* and the center of gravity position M3 of the tension imparting unit 15 in the tension imparting unit 15 of the present exemplary embodiment is significantly smaller than the distance at the tension imparting unit of Comparative Example, which does not include the counter weight 52. Thus, as compared to the curve D of Comparative Example, the curve C of the present exemplary embodiment indicates the amount of change in tension that is significantly reduced.

The inclination angle G is the intersection point between the curve C and the predetermined lower limit tension B, and represents the inclination angle of the arm 54 when the tension bar 55 is positioned at the upper limit position P1. The inclination angle K is the intersection point between the curve C and the predetermined upper limit tension A, and represents the inclination angle of the arm 54 when the tension bar 55 is positioned at the lower limit position P2. The range from the inclination angle G to the inclination angle K represents the pivoting range of the tension bar 55 when the winding unit 22 winds the medium M. Further, by matching the inclination angle G and the inclination angle K with the physical pivoting limit at which the tension bar 55 can contact the medium M, the pivoting range of the tension bar 55 can be maximized.

In FIG. 23, in the tension imparting unit of Comparative Example, the pivoting range of the tension bar when the medium M is wound around the winding unit 22 falls within the range of the inclination angle θ from the inclination angle H to the inclination angle J. As can be seen by comparing the curve C and the curve D in FIG. 23, according to the tension imparting unit 15 of the present exemplary embodiment, the range of pivoting of the tension bar 55 can be greatly increased over the tension imparting unit of Comparative Example.

Now, a slack of the medium M will be described with reference to FIG. 23. The transport roller pair 23*a* constituting the transport mechanism 23 illustrated in FIG. 1 is rotationally driven, and a force for pressing on the medium M in the transport direction is imparted to the medium M. Furthermore, with the pivoting drive of the tension imparting unit 15 and winding unit 22, a force for pulling the medium M in the transport direction is imparted to the medium M. With the pressing force and the pulling force, the medium M is transported from the transport mechanism 23 to the winding unit 22.

Next, action of the printing device 11 will be described. As illustrated in FIG. 1, while the printing unit 13 performs printing on the medium M, the medium M is transported by driving the transport mechanism 23. Against the slack, generated by transporting the medium M, in the medium M in the portion between the medium support unit 14 and the roll body R2, the tension to the medium M is imparted by pressing the medium M with the biasing force caused by falling of the tension bar 55 due to the dead weight of the tension bar 55. Every time when the tension bar 55 reaches the lower limit position P2 while the medium M is transported by the transport mechanism 23 a plurality of times, the winding unit 22 is driven. By winding the medium M by the winding unit 22, the tension bar 55 is rolled up with reducing the amount of slack of the medium M in the portion between the downstream end of the medium support unit 14 (lower end of the third support unit 26) and the roll body R2. When the tension bar 55 rises to the upper limit position P1 by winding, the drive of the winding unit 22 is stopped. In this manner, during printing, the medium M in the portion between the downstream end of the medium support unit 14 and the roll body R2 is wound by the winding unit 22 under a state of being imparted with tension by the tension bar 55.

When the transport mechanism 23 starts transport of the medium M in a state in which the tension bar 55 stops at a position greater than or equal to a predetermined height between the upper limit position P1 and the lower limit position P2, slack is generated in the medium M in the portion between the downstream end of the medium support unit 14 and the roll body R2. Because the tension imparting unit 15 of the present exemplary embodiment includes the counter weight 52, the center of gravity position of the tension imparting unit 15 is relatively located on the pivoting shaft 53 side, and the inertia is relatively larger as compared to Comparative Example in which the counter weight 52 is not included. Thus, the tension bar 55 begins to fall more slowly than that of Comparative Example with a relatively small inertia. In addition, the transport speed of the medium M by the transport mechanism 23 is relatively high from the demand for increasing the speed of printing. As a result, the falling height of the tension bar 55 from the fall start position (transport start position) to the fall end position at which the tension bar 55 falls onto the medium M tends to be increased relatively to the falling height in Comparative Example. This increase in falling height leads to the increase in falling speed when the tension bar 55 falls onto the medium M, which causes an excessive tension to be acted on the medium M. In addition, the falling height tends to increase as the elapsed time from the point at which the falling of the tension bar 55 starts to the point at which the falling of the tension bar 55 ends increases (fall duration time). Thus, the falling height fluctuates depending on the inclination angle θ of the arm 54 at the point when the medium M starts being transported, that is, the fall start position of the tension bar 55. Under a constant transport speed, the falling height increases as the fall start position of the tension bar 55 is higher. Therefore, when the tension bar 55 is positioned at a height equal to or higher than a predetermined height at the start of the transport of the medium M, an excessive tension is liable to be generated when the tension bar 55 falls onto the medium M due to the large falling height and falling speed.

Thus, in the present exemplary embodiment, when the detector 17 detects that the tension bar 55 is proximity to the medium M in a distance equal to or smaller than the distance threshold value Ls during the falling process of the tension bar 55, the biasing force adjustment unit 18 adjusts the biasing force of the tension bar 55 to a biasing force smaller than the biasing force of a case without performing an adjustment. As a result, the falling tension bar 55 starts reducing the speed when the falling tension bar 55 is proximity to the medium M in the distance equal to or smaller than the distance threshold value Ls, and fall onto (collides with) the medium M when the relative speed of the tension bar 55 with respect to the medium M is reduced to be equal to or smaller than a predetermined value. As a result, the fall speed when the tension bar 55 falls onto the medium M is relatively small, and generation of an excessive tension is avoided in the medium M.

FIG. 24 is a timing chart exemplifying the control contents by which the control unit 41 adjusts the biasing force of the tension bar 55 based on the detection result of the detector 17 during a single transport by the transport mechanism 23 between the start of the transport and the end of the transport. Now, the control contents performed by the control unit 41 will be described by following FIG. 24 with reference to FIG. 25 and FIG. 26. Note that in FIG. 24, the three graphs illustrate, the detection signal Sa of the detector 17 in the first row, the braking force Fb of the tension bar 55 in the second row, and the transport speed Vpf and the tension bar movement speed Vt (pivoting speed) in the third row.

Figure 25:
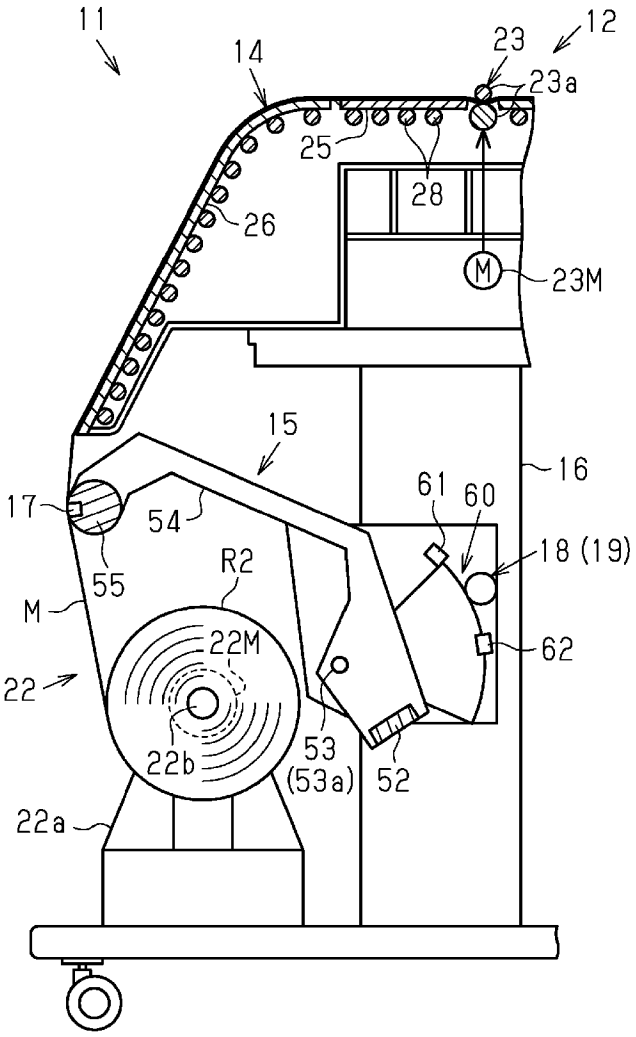
FIG. 25 is a side cross-sectional view illustrating a main portion of the printing device prior to the start of transporting the medium.
Figure 26:
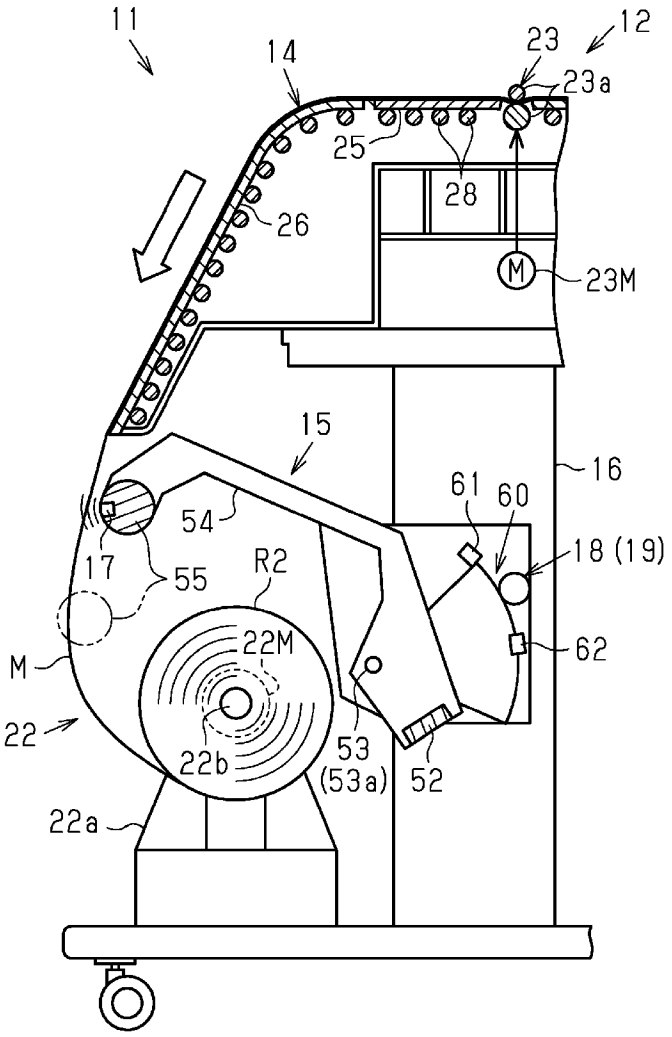
FIG. 26 is a side cross-sectional view illustrating the main portion of the printing device at the start of transporting the medium.

As illustrated in FIG. 25, the tension bar 55 is positioned at a height equal to or higher than the predetermined position under a state in which the transport mechanism 23 and the winding unit 22 are stopped together before the start of transport of the medium M where the transport of the medium M is not performed. In this case, as illustrated in FIG. 26, under the state in which the winding unit 22 is stopped, the transport mechanism 23 is driven to start the transport of the medium M. Then, when the medium M is transported at the transport speed Vpf indicated by the dot-dash line in the graph in the third row of FIG. 24, a slack is generated in the medium M in the portion between the downstream end of the medium support unit 14 and the roll body R2 (see FIG. 26). At this time, the tension bar 55 starts to descend relatively slowly due to the dead weight of the tension bar 55 and adjustment of the biasing force by the biasing force adjustment unit 18, and the movement speed Vt of the tension bar 55 gradually increases over time as illustrated in the graph in the third row of FIG. 24. Thus, as illustrated in the graph, at the start of transport of the medium M, the tension bar movement speed Vt is less than the transport speed Vpf, and hence, the tension bar 55 cannot follow the medium M moving at the transport speed Vpf, and the tension bar 55 falls toward the medium M temporarily separated.

During the falling of the tension bar 55, the detector 17 detects whether the distance between the tension bar 55 and the medium M decreased to a value equal to or smaller than the distance threshold value Ls. When the detector 17 detects the approach of the falling tension bar 55 to the medium M, the approach decreasing a distance therebetween to a value equal to or smaller than the distance threshold value Ls, the detection signal Sa from the detector 17 switches from "OFF" to "ON" as illustrated in the graph in the first row of FIG. 24. Then, the control unit 41 controls the biasing force adjustment unit 18 (braking force generating unit 19), and generates the braking force Fb in a direction opposite to the direction of the biasing force of the tension bar 55 (pivoting direction), as illustrated in the graph in the second row of FIG. 24.

As a result, as illustrated in the graph in the third row of FIG. 24, the tension bar movement speed Vt decreases. As a result, the relative speed $\Delta V$ ($=|Vt-Vpf|$) between the tension bar 55 and the medium M is reduced. Then, when the relative speed $\Delta V$ becomes smaller than the predetermined value, the tension bar 55 collides with the medium M. In this way, the relative speed $\Delta V$ between the tension bar 55 and the medium M can be relatively small, and the collision energy between the tension bar 55 and the medium M can be suppressed. As a result, generation of an excessive tension is suppressed in the medium M when the tension bar 55 collides with the medium M. Note that the detector 17 is in the "ON" state when the tension bar 55 is in contact with the medium M at the start of transport, but such situation is not regarded as detection of proximity. Instead, the detector 17 detects the proximity when switched from "OFF" to "ON" after the tension bar 55 separated from the medium M in a distance exceeding the distance threshold value Ls and switched from "ON" to "OFF".

Due to assembly accuracy (tolerance) or the like of the printing device 11, in the transport path from the transport mechanism 23 to the winding unit 22, a difference may occur between a transport path length on a +X-axis side (first end) and a transport path length on a −X-axis side (second end) in the width direction of the medium M. For example, when the transport path length on the +X-axis side is slightly shorter than the transport path length on the −X-axis side, a slack is generated in the medium M in the transport path on the +X-axis side (the side on which the transport path length is shorter). When the slack is generated in the medium M on the short side of the transport path length, high tension is generated unevenly on the long side of the transport path length.

When the transport operation of the transport mechanism 23 is performed a predetermined plurality of times (for example, 2 to 5 times), the winding unit 22 is rotationally driven each time the tension bar 55 reaches the inclination angle J of the predetermined upper tension force (dashed line A) illustrated in FIG. 23. As a result, the medium M is wound on the roll body R2, and the tension bar 55 is rolled up and moves upward. In this winding process, the medium M is imparted with a pulling force by rotational driving of the winding unit 22 in addition to a predetermined upper limit tension. At this time, in the case where there is a difference in the length of the transport path at both the ends in the width direction described above, when the winding unit 22 is driven, a couple of force is generated so that the −X-axis side (second end) having the long transport path rotates about the +X-axis side end (first end) having the short transport path in the winding unit 22. This couple of force generates a concentration line extending obliquely in which tension is concentrated from the second end on the side with the long transport path length of the winding unit 22 to the first end on the side with the short transport path length of the transport roller pair 23*a* in the rectangular region of the medium M in the portion between the transport roller pair 23*a* and the winding unit 22. This tension concentration line causes a pulling force toward downstream in the transport direction on the first end of the medium M in the width direction in the transport mechanism 23, the pulling force stronger than that on the second end.

It is assumed that the tension generated by the winding operation of the winding unit 22 and the relatively large biasing force when the tension bar 55 falls are added under the state in which this tension concentration line is generated. In this case, on the first end side having the short transport path length, the pulling force toward downstream in the transport direction is larger than the frictional force between the medium M and the transport mechanism 23. Consequently, a vicious cycle is repeated in which the medium M on this first end side with a slack of the medium M slides toward downstream in the transport direction to further increase the slack of the medium M. When this slack is accumulated, there may be a possibility twists and creases may be formed on the medium M to be wound eventually by the winding unit 22.

Because the tension imparting unit 15 of the present exemplary embodiment includes the counter weight 52, the angle range (pivoting range) in which the tension bar 55 swings can be wider. Thus, the number of times of winding of the medium M can be relatively reduced compared to the tension imparting unit of Comparative Example that does not include the counter weight 52. In the printing device 11 according to the present exemplary embodiment, the tension bar 55 rotates from the upper limit position P1 to the lower limit position P2 by transporting performed by the transport mechanism 23 a predetermined plurality of times (for example, 2 to 5 times). Thus, the winding unit 22 may perform a single winding operation for a plurality of transport operations by the transport mechanism 23. Of both the ends of the medium M in the width direction, the end on the side having the short transport path length with a slack slides toward downstream in the transport direction with respect to the transport mechanism 23 at the time of winding, and thus the number of winding operations of the winding unit 22, which may cause such slack to further increase, can be reduced. As a result, the frequency of increasing the slack of the medium M on the first end side in the width direction in the portion between the transport roller pair 23*a* and the winding unit 22 can be greatly reduced.

On the other hand, because the tension imparting unit 15 provided with the counter weight 52 has a larger inertia, the tension bar 55 moves more slowly than the tension imparting unit of Comparative Example when the tension bar 55 falls due to the dead weight of the tension bar 55. Thus, there is a concern that the falling height of the tension bar 55 and the collision speed of the tension bar 55 with respect to the medium M become relatively large. However, in the present exemplary embodiment, when the detector 17 detects that the falling tension bar 55 is proximity to the medium M, the biasing force adjustment unit 18 adjusts the biasing force of the tension bar 55 to a biasing force smaller than the biasing force of a case without performing an adjustment. As a result, generation of an excessive tension is avoided in the medium M when the tension bar 55 falls onto (collides with) the medium M. Thus, the situation in which the falling impact of the tension bar 55 further increases the slack of the medium M on the first end side (side having the short transport path length) with the slack of the medium M can effectively suppresses. Thus, the transport position accuracy of the medium M by the transport mechanism 23 is increased, and along with this, the printing position accuracy of the printing unit 13 is increased. Consequently, the printing quality of the medium M wound by the winding unit 22 can be increased, and twists and creases can be prevented 22 more effectively from being formed on the medium M wound by the winding unit.

According to the exemplary embodiment, the following advantages can be obtained.

(1) The transport device 12 includes the tension imparting unit 15 including the tension bar 55 as one example of a tension imparting member, which is biased toward the medium M between the transport mechanism 23 as one example of a first transport unit and the winding unit 22 as one example of a second transport unit and imparts the tension to the medium M. Furthermore, the transport device 12 includes the detector 17 and the biasing force adjustment unit 18 as one example of an adjustment unit. The detector 17 detects the approach of the tension bar 55 to the medium M, the approach decreasing a distance therebetween to a value equal to or smaller than the distance threshold value Ls. The biasing force adjustment unit 18 adjusts the relative speed of the tension bar 55 with respect to the medium M to a relative speed smaller than the relative speed of a case without performing an adjustment when the detector 17 detects that the tension bar 55 approached the medium M. When the transport speed Vpf of the transport mechanism 23 is greater than the winding speed Vw of the winding unit 22, the tension bar 55 cannot follow the slack formed on the medium M in the portion between the transport mechanism 23 and the winding unit 22, and the tension bar 55 may collide with the medium M after the medium M is temporarily separated from the tension bar 55. At this time, when the detector 17 detects the approach that decreases a distance between the tension bar 55 and the medium M to a value equal to or smaller than the distance threshold value Ls, the biasing force adjustment unit 18 adjusts the relative speed of the tension bar 55 with respect to the medium M to be smaller than the relative speed in the case where the relative speed is not adjusted. As a result, the tension generated in the medium M when the tension bar 55 collides with the medium M can be reduced. Thus, the transport misalignment of the medium M in the transport mechanism 23, which is caused by application of an excessive tension to the medium M, can be suppressed to a small degree. The transport accuracy of the medium M by the transport mechanism 23 can be maintained at a constant level, and printing with high accuracy and high image quality can be performed on the medium M. In addition, in a state in which the tension concentration line extending obliquely from the transport mechanism 23 to the winding unit 22 is formed on the medium M by a difference in the transport path length between both the ends in the width direction and a driving force of the winding unit 22, the slack on the medium M, which is caused on the long transport path length side of both the ends in the width direction of the medium M, is further increased due to the excessive tension at the time of collision of the tension bar 55 with the medium M. Such vicious cycle is suppressed. Thus, twists and creases, which are formed on the medium M wound by the winding unit 22 due to increase of this type of slack on the medium M, can be suppressed.

(2) The detector 17 is provided to the tension bar 55. Thus, the detector 17 can detect the approach of the tension bar 55 to the medium M without the medium M or the tension bar 55 being an obstruction.

(3) The detector 17 is a contact type that performs detection through contact with the medium M. When the medium M is a transparent medium or a mesh-like (net-like) medium, the medium M cannot be detected by the optical detector, and it is impossible to detect the approach of the tension bar 55 to the medium. However, because the detector 17 is of contact type, the detector 17 can detect the approach of the tension bar 55 to the medium M even when the medium is a transparent medium or a mesh-like medium.

(4) The transport device 12 includes the biasing force adjustment unit 18 capable of adjusting the biasing force of the tension bar 55. When the detector 17 detects the approach that decreases a distance between the tension bar 55 and the medium M to a value equal to or smaller than the distance threshold value Ls, the biasing force adjustment unit 18 adjusts the biasing force of the tension bar 55 to a biasing force smaller than the biasing force of a case without performing an adjustment. As a result, generation of an excessive tension can be avoided in the medium M when the tension bar 55 and the medium M collide with each other.

(5) When the detector 17 detects the approach that decreases a distance between the tension bar 55 and the medium M to a value equal to or smaller than the distance threshold value Ls, the biasing force adjustment unit 18 imparts a braking force to the tension bar 55. Thus, the movement speed of the tension bar 55 can be reduced as compared to the movement speed of a case without performing an adjustment, and the relative speed of the tension bar 55 with respect to the medium M at the time of collision can be suppressed to a small degree. As a result, generation of an excessive tension is avoided in the medium M when the tension bar 55 collides with the medium M.

(6) The transport device 12 includes the transport mechanism 23, the winding unit 22 disposed on a downstream of the transport mechanism 23 in the transport direction, the tension imparting unit 15 including the tension bar 55 that is biased toward the medium M between the transport mechanism 23 and the winding portion 22 and imparts tension to the medium M, and the biasing force adjusting portion 18 that adjusts the biasing force of the tension bar 55. The tension is imparted to the medium M by the tension bar 55 biasing the medium M in the portion between the transport mechanism 23 and the winding unit 22. A slack and pulling of the medium M occur due to a difference in speed between the transport speed of the transport mechanism 23 and the transport speed of the winding unit 22. In other words, when the transport speed of the transport mechanism 23 is greater than the transport speed of the winding unit 22, a slack is generated on the medium M, and when the transport speed of the transport mechanism 23 is less than the transport speed of the winding unit 22, the medium M is pulled. A slack or pulling generated on the medium M causes tension fluctuations in the medium M. However, the biasing force of the tension bar 55 is adjusted by the biasing force adjustment unit 18, and hence the fluctuations in tension of the medium M in the portion between the transport mechanism 23 and the winding portion 22 can be reduced to a small degree. For example, at least one of transport misalignment of the medium M of the transport mechanism 23 and winding misalignment of the medium M of the winding unit 22, which are caused by the fluctuations of tension of the medium M, can be suppressed.

(7) The transport device 12 includes the detector 17 configured to detect the approach that decreases a distance between the tension bar 55 and the medium M to a value equal to or smaller than the distance threshold value Ls. The biasing force adjustment unit 18 adjusts the biasing force of the tension bar 55 to a smaller biasing force when the detector 17 detects the approach that decreases a distance between the tension bar 55 and the medium M. When the transport speed of the transport mechanism 23 is greater than the winding speed of the winding unit 22, the tension bar 55 cannot follow the movement of the medium M in the portion between the transport mechanism 23 and the winding unit 22, and the medium M is temporarily separated from the tension bar 55. Thereafter, when it is detected the approach that decreases a distance between the tension bar 55 and the medium M to a value equal to or smaller than the distance threshold value Ls, the biasing force adjustment unit 18 adjusts the biasing force of the tension bar 55 to a smaller biasing force. Thus, the following delay of the tension bar 55 with respect to the medium M can be suppressed to a small degree, and the impact (collision energy) of the tension bar 55 during the collision with the medium M can be alleviated.

(8) The biasing force adjustment unit 18 functions as the braking force generating unit 19 that generates a braking force to the tension imparting unit 15 in the direction of reducing the biasing force. Therefore, the biasing force is adjusted to a smaller biasing force by the braking force generated to the tension imparting unit 15 as compared to the case where the braking force is not generated. Thus, the impact (collision energy) when the tension bar 55 collides with the medium M can be alleviated, and generation of an excessive tension in the medium M can be avoided.

(9) The braking force generating unit 19 generates a braking force by applying a load to the tension imparting unit 15, and the load is any one of the driving force of the drive source, the frictional load, the viscous load, the elastic load, and the shift of the center of gravity of the tension imparting unit 15. Thus, by applying the tension imparting unit 15 with any one of the driving force of the drive source, the frictional load, the viscous load, the elastic load, and the shift of the center of gravity of the tension imparting unit 15, the braking force is generated. Thus, the tension bar 55 can be applied with the braking force with a relatively simple configuration, and the biasing force of the tension bar 55 can be adjusted to a small degree.

(10) The braking force generating unit 19 is configured to adjust the braking force generated in the tension imparting unit 15. Thus, the braking force generated in the tension imparting unit 15 can be adjusted in accordance with the difference in position (movement start position) at the start of the movement of the tension bar 55 and the difference in relative speed at which the tension bar 55 and the medium M come into contact with each other only by the biasing force of the tension bar 55 itself. Thus, the relative speed at which the tension bar 55 and the medium M come into contact with each other can be reduced within a desired predetermined range.

(11) The braking force generating unit 19 changes the braking force in accordance with the position (movement start position) of the tension bar 55 at which the transport mechanism 23 starts transporting the medium M. As a result, different braking forces are imparted to the tension imparting unit 15 in accordance with the position of the tension bar 55 at which the transport mechanism 23 starts transporting the medium M. Thus, the relative speed at which the tension bar 55 and the medium M come into contact with each other can be reduced within the appropriate predetermined range regardless of the movement start position of the tension bar 55. Accordingly, the impact (collision energy) when the tension bar 55 collides with the medium M can be appropriately alleviated, and an appropriate tension can be imparted to the medium M. For example, a situation in which an excessive tension can be generated in the medium M or the tension of the medium M is insufficient can be avoided.

(12) The printing device 11 includes the transport device 12 and the printing unit 13 configured to perform printing on the medium M transported by the transport device 12. Thus, with the printing device 11, the effects similar to those of the transport device 12 can be obtained. Thus, a high-quality printed material can be provided.

Second Exemplary Embodiment

Next, a second exemplary embodiment will be described with reference to the accompanying drawings. The second exemplary embodiment differs from the first exemplary embodiment in that the configuration of the detector does not include a sensor. Configurations similar to those in the first exemplary embodiment will be given the same reference symbols and detailed description therefor will be omitted. The configuration of the detector will be described mainly.

Figure 27:
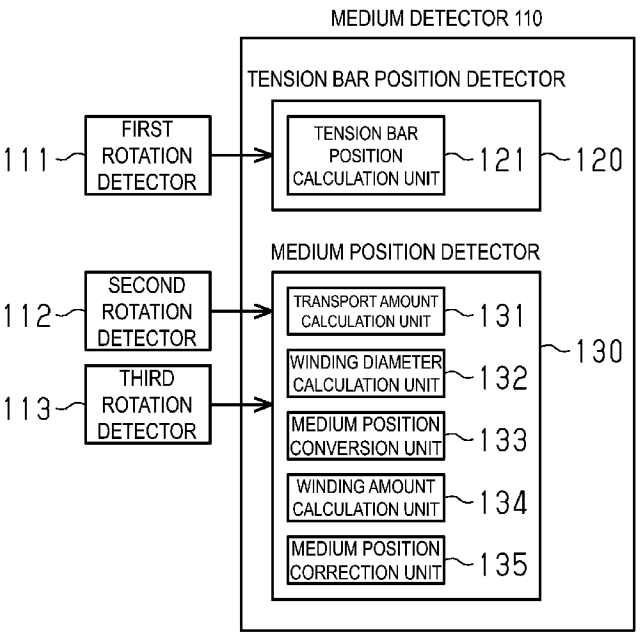
FIG. 27 is a block diagram illustrating a configuration of a medium detector in a second exemplary embodiment.

As illustrated in FIG. 27, in the control unit 41, the transport device 12 includes a medium detector 110 as one example of a detector configured to detect, without using a sensor, the approach of the tension bar 55 to the medium M. The medium detector 110 includes, as one example of the tension imparting member position acquisition unit, a tension bar position detector 120 configured to detect a position of the tension bar 55, and, a medium position detector 130 as one example of a medium position acquisition unit configured to detect a position of the medium M.

The transport device 12 includes a first rotation detector 111 configured to detect rotation of the pivoting shaft 53 of the tension imparting unit 15. The first rotation detector 111 may be a rotary detector such as a rotary encoder that detects rotation of the pivoting shaft 53, or may acquire the rotation information from the rotation command value (drive information) that controls the electric motors 56, 93, and 105 in a case where the biasing force adjustment unit 18 is electrically powered.

The tension bar position detector 120 successively detects the position (pivoting angle θ) of the tension bar 55 based on the detection values of the sensor unit 60 and the first rotation detector 111. The tension bar position detector 120 includes a tension bar position calculation unit 121 illustrated in FIG. 27. After the transport operation of the transport mechanism 23 is started, the tension bar position calculation unit 121 perform mechanical calculations to successively acquire the position of the tension bar 55 in accordance with the elapsed time t from the transport start timing by using the rotational moment, which is the known information of the tension imparting unit 15, and each numerical value of the inertia.

Further, the transport device 12 includes a second rotation detector 112 configured to detect the rotation of the transport mechanism 23 and a third rotation detector 113 configured to detect the rotation of the winding unit 22. The second rotation detector 112 may be a rotary detector such as a rotary encoder that detects rotation of the transport roller pair 23*a*, or may acquire rotational information from the rotation command value of the transport motor 23M. Further, the third rotation detector 113 may be a rotary detector such as a rotary encoder that detects rotation of the winding unit 22, or may acquire rotational information from the rotational command value (drive information) of the winding motor 22M. The medium position detector 130 acquires the position of the medium M by calculation according to the transport amount of the medium M based on the detection value of the second rotation detector 112 and the winding amount of the medium M based on the detection value of the third rotation detector 113.

As illustrated in FIG. 27, the medium position detector 130 includes a transport amount calculation unit 131, a winding diameter calculation unit 132, a medium position conversion unit 133, a winding amount calculation unit 134, and a medium position correction unit 135.

After the transport mechanism 23 starts the transport operation, the transport amount calculation unit 131 successively calculates the transport amount by which the transport mechanism 23 transports the medium M until the transport mechanism 23 reaches the transport position (target position) at that time. The transport amount calculation unit 131 sequentially accumulates the drive information of the transport motor 23M or the rotation detection information of the second rotation detector 112, and calculates the transport amount of the medium M in accordance with the elapsed time t from the start timing of the falling of the tension bar 55. Note that when the winding unit 22 is driving (during rolling up) at the start of the transport operation of the transport mechanism 23, the transport amount calculation unit 131 starts calculation of the transport amount after waiting for the end of the drive until the tension bar 55 is ready to fall.

The winding diameter calculation unit 132 monitors the load of the drive motor of the winding unit 22 while the transport mechanism 23 transports and slacks, by a predetermined amount, the medium M set in a state of being pulled by the winding unit 22 and the medium M with a slack is wound by the winding unit 22. When the monitored load exceeds the threshold value by eliminating the slack of the medium M and stretching the medium M, the winding diameter calculation unit 132 calculates the circumferential length (winding amount per revolution) of the roll body R2 based on the ratio (fixed amount/rotation amount) of the rotation amount information when the winding unit 22 is rotated and the fixed amount (transport amount) by which the transport mechanism 23 transports in advance, and further calculates the winding diameter based on the circumferential length.

The medium position conversion unit 133 calculates the transport amount corresponding to the elapsed time t from the start timing of falling (for example, at the start of transport) of the tension bar 55 as the slack amount. Furthermore, the medium position conversion unit 133 calculates the pivoting amount Δθ (the angle amount) of the tension bar 55 from the start of the falling of the tension bar 55 until it comes into contact with the medium M having the slack amount. In other words, with a state in which the medium M is stretched without a slack at the start position of falling as a reference (Δθ=0), the medium position reducing unit 133 determines the pivoting amount Δθ (angle amount) by which the tension bar 55 rotates to come into contact with the medium M with a slack having the slack amount determined by the transport amount.

The winding amount calculation unit 134, during falling of the tension bar 55, successively calculates the winding amount that reduces the slack amount of the medium M by winding of the winding unit 22, based on the drive amount of the winding unit 22 when winding is performed and the winding diameter calculated by the winding diameter calculation unit 132.

In consideration of a reduced slack amount equivalent to the winding amount in addition to the medium position information obtained by the medium position conversion unit 133, the medium position correction unit 135 corrects the slack amount of the medium M, and corrects the pivoting amount Δθ (angle amount) by which the tension bar 55 rotates to come into contact with the medium M by using the corrected slack amount. In other words, with the state in which the medium M is stretched without a slack at the start position of falling as a reference (Δθ=0), the medium position correction unit 135 determines the pivoting amount Δθ (angle amount) by which the tension bar 55 rotates to come into contact with the medium M with a slack having the slack amount determined by the difference between the transport amount and the winding amount (=winding rotation amount×winding diameter). In this manner, the medium position detector 130 acquires, as position information of the medium M, a position on the medium M side at which the falling tension bar 55 comes into contact with the medium M with a slack having a slack amount at that time.

With reference to a relative difference between the two positions based on the position information of the tension bar 55 detected by the tension bar position detector 120 and the position information of the medium M detected by the medium position detector 130, the medium detector 110 acquires the distance between the tension bar 55 and the medium M in the pivoting direction (on the pivoting path) of the tension bar 55. Further, when the obtained distance exceeds the distance threshold value Ls, the medium detector 110 does not detect proximity between the tension bar 55 and the medium M. In contrast, when the obtained distance is equal to or smaller than the distance threshold value Ls, the medium detector 110 detects proximity between the tension bar 55 and the medium M.

When the medium detector 110 detects proximity where the distance between the tension bar 55 and the medium is equal to or smaller than the distance threshold value Ls, the control contents by which the control unit 41 control the biasing force adjustment unit 18 are the same as those in the first exemplary embodiment described above.

According to the second exemplary embodiment described above, the following advantages can be obtained.

(13) The medium detector 110 as one example of the detector includes the medium position detector 130 as one example of the medium position acquisition unit configure to acquire the position of the medium M, and the tension bar position detector 120 as one example of the tension imparting member position acquisition unit configured to acquire the position of the tension bar 55. Based on the position of the medium M acquired by the medium position detector 130 and the position of the tension bar 55 acquired by the tension bar position detector 120, the medium detector 110 detects the approach that decreases a distance between the tension bar 55 and the medium M to a value equal to or smaller than the distance threshold value Ls. Thus, even in a case where a sensor (detector) dedicated to proximity detection is not provided, the proximity of the tension bar 55 and the medium M can be detected by using the detection information obtained from a sensor of the existing transport system provided with the transport device 12 (for example, a rotary encoder) or the drive information obtained from a motor or the like. Furthermore, the medium detector 110 is included in place of the detector 17, and hence the effects similar to the effects (1) to (12) in the first exemplary embodiment can be obtained.

Third Exemplary Embodiment

Next, a third exemplary embodiment will be described with reference to the accompanying drawings. The third exemplary embodiment is the same as the first and second exemplary embodiments except that the biasing force adjustment unit 18 is not included. Hereinafter, configurations different from those in the above-described exemplary embodiments will be described.

Figure 28:
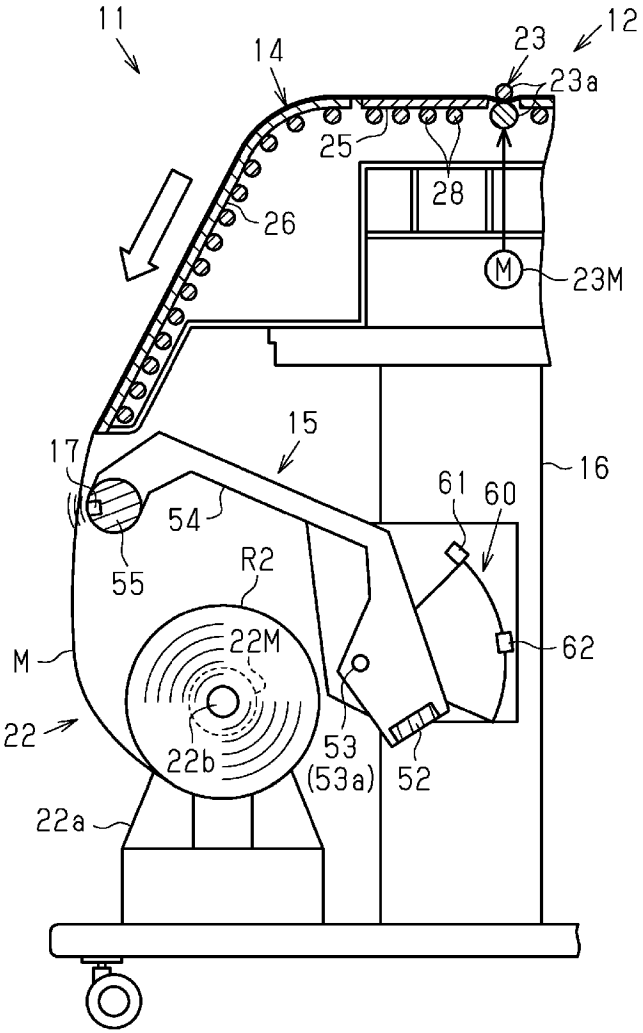
FIG. 28 is a partial side cross-sectional view illustrating the printing device at the start of transporting the medium in a third exemplary embodiment.

As illustrated in FIG. 28, the printing device 11 does not include the biasing force adjustment unit 18 (braking force generating unit 19) provided with the transport device 12 in the first and second exemplary embodiments. The adjustment for reducing the relative speed of both the tension bar 55 and the medium M when the falling tension bar 55 and the medium M collide with each other is performed by the control unit 41 (see FIG. 1 and FIG. 21) in the following manner. That is, the control unit 41 drives and controls the winding unit 22 during the drive of the transport mechanism 23, and adjusts at least one of the position of the medium M and the movement speed of the medium M at which the falling tension bar 55 comes into contact with the medium M. Note that, the first exemplary embodiment and the second exemplary embodiment are different from each other only in the detection method of detecting proximity between the tension bar 55 and the medium M, and hence, the example in which the detector 17 in the first exemplary embodiment is included will be described below.

Figure 30:
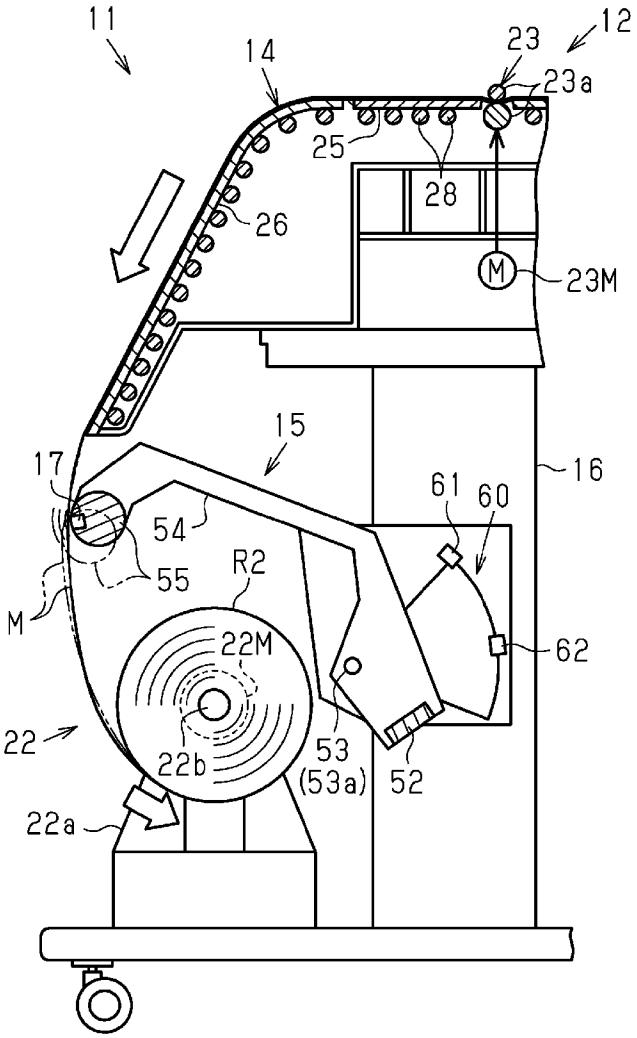
FIG. 30 is a partial side cross-sectional view illustrating the printing device that performs control for adjusting a relative speed between the tension bar and the medium while the tension bar is dropping.
Figure 31:
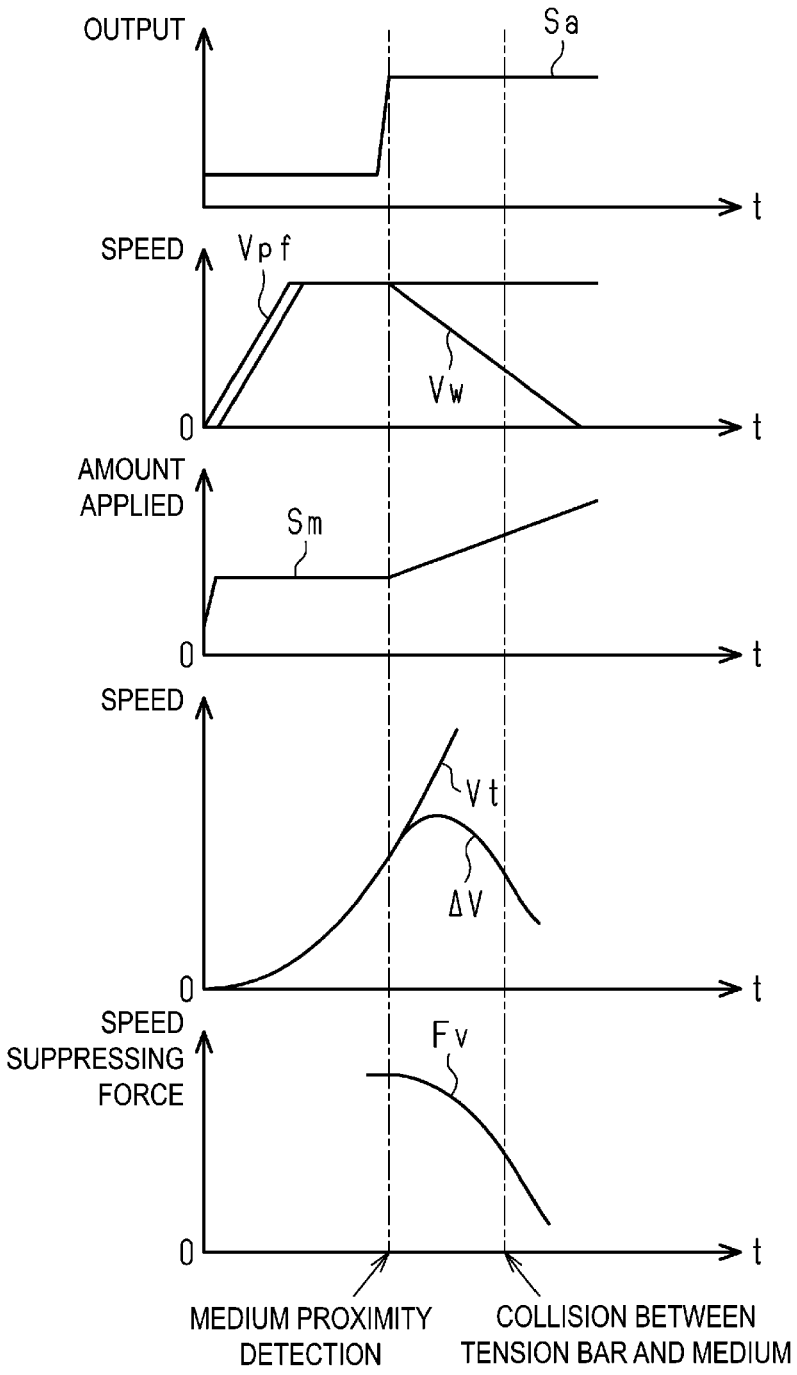
FIG. 31 is a timing chart illustrating the biasing force adjustment control of the tension bar.

FIG. 31 is a timing chart illustrating the control contents by which the control unit 41 adjusts the biasing force of the tension bar 55 based on the detection result of the detector 17 during a single transport operation performed by the control unit 41 controlling the transport mechanism 23. In FIG. 31, the five graphs illustrate the detection signal Sa of the detector 17 in the first row, the transport speed Vpf and the winding speed Vw in the second row, the slack amount Sm of the medium M in the third row, the tension bar movement speed Vt and the relative speed ΔV between the tension bar 55 and the medium M in the fourth row, and the speed suppressing force Fv in the fifth row. Here, the speed suppressing force Fv refers to a force comparable to that acted on the tension bar 55 to suppress the relative speed ΔV to a small degree between the tension bar 55 and the medium M. Now, the contents of control performed by the control unit 41 will be described by following FIG. 31 with reference to FIG. 28 and FIG. 30.

Figure 29:
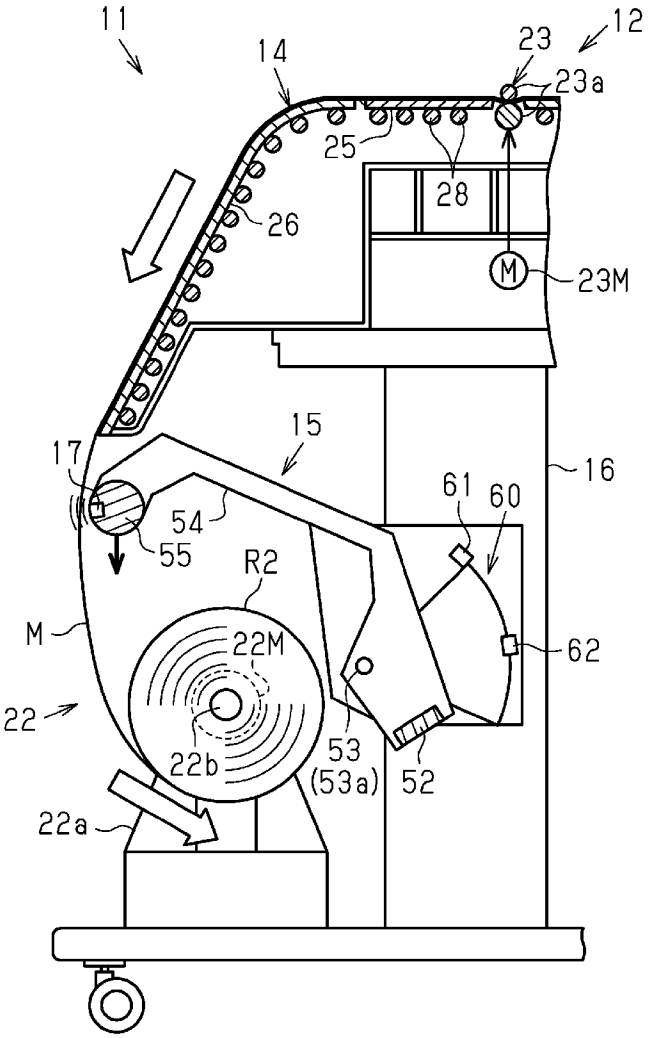
FIG. 29 is a partial side cross-sectional view illustrating the printing device when the tension bar is dropping.

As illustrated in the graph in the second row of FIG. 31, the transport mechanism 23 is first driven to start transport of the medium M at the transport speed Vpf. Thereafter, the winding unit 22 is driven slightly later, and winding of the medium M is started at the winding speed Vw. At this time, the transport speed Vpf and the winding speed Vw are controlled at the same speed (Vpf=Vw) in the constant speed range although the drive start timing is slightly shifted. In other words, as illustrated in FIG. 28, first, under the state in which the winding unit 22 is stopped, the transport mechanism 23 is driven to start transport of the medium M, and a slack is generated in the medium M in a portion between the medium support unit 14 and the roll body R2. Then, as illustrated in FIG. 29, driving of the winding unit 22 is started slightly after the start of driving of the transport mechanism 23, and the winding of the medium M is performed at the winding speed Vw being the same speed as the transport speed Vpf of the winding unit 22. Thus, as illustrated in the graph in the third row of FIG. 31, the slack amount Sm of the medium M is maintained constant in the portion between the medium support unit 14 and the roll body R2. As a result, the falling height from the falling start position of the tension bar 55 to the contact with the medium M is maintained substantially constant.

The detector 17 fixed to the tension bar 55 detects whether the distance between the tension bar 55 and the medium M decreased to a value equal to or smaller than the distance threshold value Ls during the falling of the tension bar 55. When it is detected that the falling tension bar 55 is proximity to the medium M to have a distance between the two equal to or smaller than the distance threshold value Ls, the detection signal Sa from the detector 17 switches from "OFF" to "ON" as illustrated in the graph in the first row of FIG. 31. Subsequently, as illustrated in FIG. 30 and illustrated in the graph in the second row of FIG. 31, the control unit 41 controls the winding unit 22 to decelerate or stop the drive. In this manner, the winding speed Vw is reduced.

As a result, as illustrated in the graph in the third row of FIG. 31, the slack amount Sm of the medium M increases in the portion between the medium support unit 14 and the roll body R2. As a result, the position of the medium M on the descending path of the tension bar 55 descends in the same direction as the movement direction (descending direction) of the tension bar 55. Thus, as illustrated in the graph in the fourth row of FIG. 31, although the movement speed Vt of the tension bar 55 increases, the relative speed ΔV between the tension bar 55 and the medium M is reduced. Then, when the relative speed ΔV becomes equal to or less than a predetermined value, the tension bar 55 falls onto the medium M. Thus, the collision energy between the tension bar 55 and the medium M is suppressed to a small degree. This is comparable to the fact that the speed suppressing force Fv illustrated in the graph in the fifth row of FIG. 31 acts on the tension bar 55 although the biasing force adjustment 18 is not included. In this manner, in spite of the fact that the transport device 12 does not include the biasing force adjustment unit 18, the impact when the tension bar 55 falls onto the medium M is alleviated by controlling the winding unit 22 to adjust the movement speed of the medium M.

According to the third exemplary embodiment described above, the following advantages can be obtained.

(14) When the detector 17 detects the approach that decreases a distance between the tension bar 55 and the medium M to a value equal to or smaller than the distance threshold value Ls, the control unit 41 as one example of the adjustment unit controls the winding portion 22 to adjust the relative speed ΔV between the tension bar 55 and the medium M to be smaller than the relative speed of a case without performing an adjustment. Therefore, it is not necessary to provide a unit such as the biasing force adjustment unit 18 (braking force generating unit 19) that adjusts the speed of the tension bar 55 to adjust the relative speed ΔV. Thus, the configuration of the transport device 12 can be simplified compared to the configuration provided with this type of unit configured to adjust the biasing force. In addition, although the biasing force adjustment unit 18 is not included, the same effects as the effects (1) to (12) in the first exemplary embodiment and the effects (13) in the second exemplary embodiment can be obtained.

The above-described exemplary embodiments may be modified as the following modified examples. Moreover, the configurations in the exemplary embodiments and configurations in the following modified examples may optionally be combined, or the configurations in the following modified examples may optionally be combined to each other.

In the first exemplary embodiment, the biasing force adjustment unit 18 may be omitted. For example, when the detector 17 detects proximity to the medium M, winding of the winding unit 22 may be started. According to this configuration, the falling height of the tension bar 55 is reduced. Thus, the descending speed of the tension bar 55 can be reduced at the time of collision with the medium M, and the relative speed of the two can be reduced by adjusting the winding ascending speed of the medium M.

In each of the exemplary embodiments described above, regardless of the position of the tension bar 55 higher than a predetermined height, every time the tension bar 55 falls due to the transport of the medium M by the transport mechanism 23, the above-mentioned control for adjusting the relative speed of the tension bar 55 and the medium M to be smaller may be performed.

The detector 17 is provided on the surface portion that contacts with the medium M in the tension bar 55 as one example of the tension imparting member. However, the detector 17 may be provided on a surface portion that does not contact with the medium M in the tension bar 55. In this case, the detector may be a contact type or a non-contact type, but in the case of a contact type, the surface shape of the tip end portion of the detector may be a shape that does not damage the medium M.

The detector may be a camera (imaging unit) provided on the tension bar 55 as one example of the tension imparting member. For example, the image captured by the camera may be analyzed by an image analysis unit in the control unit 41 to detect proximity where the distance between the tension bar 55 and the medium M is equal to or smaller than the distance threshold value Ls.

The detector may not be provided to the tension bar 55. For example, the camera (imaging unit) as one example of the detector may be disposed at a side position of the tension imparting unit 15. An aspect in which the tension bar 55 falls on the medium M may be captured by the camera, and the image obtained by the imaging may be analyzed to detect that the tension bar 55 is proximity to the medium M in a distance equal to or smaller than the distance threshold value Ls.

The distance threshold Ls may be a value greater than zero, but may also be zero. For example, even when the adjustment unit starts the adjustment at the time of the contact between the tension bar 55 and the medium M, the adjustment unit, which is capable of quickly adjusting the movement speed of the tension bar 55 or the medium M, can at least adjust the relative speed of the two during the time period from the contact timing to the timing at which the entire load of the tension bar 55 is applied to the medium M. In this case, the tension generated in the medium M when the tension bar 55 collides with the medium M can be suppressed to a small degree.

The orientation of the detector 17 with respect to the tension bar 55 may be configured to be changeable in accordance with the position (pivoting angle θ) of the tension bar 55. According to this configuration, it can be detected further accurately whether the distance between the tension bar 55 and the falling position on the medium M is equal to or smaller than the distance threshold value Ls.

The distance threshold Ls used by the detector 17 for detection may be changed in accordance with the position (pivoting angle θ) of the tension bar 55. According to this configuration, the timing at which the biasing force adjustment unit 18 starts adjusting the biasing force can be adjusted.

Adjustment by the adjustment unit may be performed by using adjustment of the moving speed of the tension bar 55 by the biasing force adjustment unit 18 in combination with adjustment of the moving speed of the position (contact position) on the moving path of the tension bar 55 on the medium M by control of the winding 22.

The biasing force adjustment unit 18 in FIG. 13, FIG. 16, and FIG. 17 may have a configuration of performing switching through an electromagnetic clutch in place of a configuration in which the planetary gears 571 are attached and detached. For example, the configuration is that an electromagnetic clutch is interposed between the electric motor 56 and the pivoting shaft 53 in the middle of the power transmission path, and the control unit 41 brings the electromagnetic clutch into contact and non-contact. When adjustment of the biasing force of the tension bar 55 is required such as the falling timing of the tension bar 55, the electromagnetic clutch may be coupled. When such adjustment is not required, the coupling of the electromagnetic clutch may be shut. According to this configuration, the same effects as those of the biasing force adjustment unit 18 illustrated in FIG. 16 and FIG. 17 can be obtained, and the force in the direction opposite the braking force (downward direction) can be imparted when the tension bar 55 descends.

In the third exemplary embodiment, the contents of the control, which are performed by the control unit 41 as one example of the adjustment unit, for the winding unit 22 to adjust the relative speed of the tension bar 55 and the medium M to be smaller than the relative speed of a case without performing an adjustment, can be changed as appropriate. The winding speed Vw may be different from the transport speed Vpf. Additionally, the tension bar 55 may collide with the medium M with maintaining the winding speed Vw and the transport speed Vpf constant.

Figure 20:
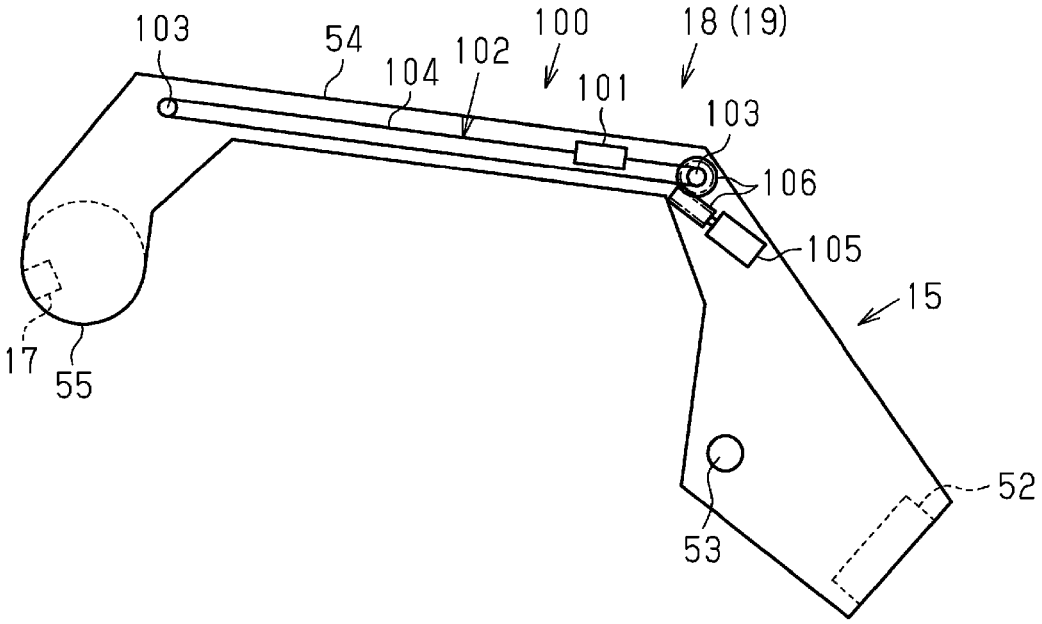
FIG. 20 is a schematic side view illustrating the biasing force adjustment unit of a configuration example different from that in FIG. 19.

In FIG. 20, in the configuration in which the braking force is generated by shifting the center of gravity of the tension imparting unit 15, the movement mechanism that moves the weight portion may be a ball screw type or a linear motor method in place of the belt movement method. Further, a cylinder such as an air cylinder may be used as the drive source.

The biasing force adjustment unit 18 may adjust the biasing force that accelerates the tension bar 55 in the pivoting direction during falling in at least a part of a time period until the proximity between the tension bar 55 and the medium M is detected. In this case, when the tension bar 55 is at a relatively high position and falls only due to the dead weight of the tension bar 55, the tension bar 55 starts moving slowly. However, by adjusting the biasing force in the pivoting direction at the time of falling of the tension bar 55 to be larger, the falling height of the tension bar 55 can be relatively reduced. Thus, generation of an excessive tension on the medium M can be effectively avoided at the time of falling of the tension bar 55.

In the first exemplary embodiment, the detector 17 may be eliminated. For example, in a case where the control unit 41 determines that the movement start position of the tension bar 55 is equal to or higher than the predetermined height based on the detection signal from the sensor that detects the position of the tension bar 55 (for example, the pivoting angle θ), the control unit 41 may be configured to drive the biasing force adjustment unit 18 immediately or after a specific delay time has elapsed when the transport mechanism 23 starts transporting the medium M.

The tension imparting member is not limited to a pivoting type such as the tension bar 55 illustrated in the exemplary embodiments described above. For example, a linear motion method may be employed to bias the tension imparting member movably in the Y-axis direction, or bias movably in the Z-axis direction. In this case, the biasing force of the tension imparting member may be generated by using the power of the drive source such as an electric motor or the elastic force of the spring.

A single winding operation may be performed each time the transport operation is performed, or a single winding operation may be performed each time the sensor unit 60 detects that the tension bar 55 reaches the lower limit position.

The counter weight 52 may be configured not to be included.

The printing device is not limited to a serial printer or a line printer, and may be a lateral type printer in which the carriage can move in two directions, that is, the main scanning direction and the sub scanning direction.

The printing device is not limited to an ink-jet type printer, and may be an electrophotographic printer, a dot impact type printer, a heat transfer type printer, and a textile printing device.

The printing device may eject liquid droplets of a liquid body (ink) in which particles of a functional material are dispersed or mixed into a liquid, onto a medium made of an elongated thin base material (substrate) dispensed from a roll body, by using, for example printing techniques. For example, the printing device may eject droplets of a liquid body in which metal powder such as a wiring material is dispersed as the particles of the functional material, and may form an electrical wiring pattern on the substrate. Additionally, the printing device may eject droplets of a liquid body in which powder of a color material (pixel material) is dispersed as the particles of the functional material, and may manufacture a pixel of a display (display substrate for a display device) of various types such as a liquid crystal type, electroluminescence (EL) type, and a plane emission type.

This application claims priority under 35 U.S.C. § 119 to Japanese Patent Applications No. 2017-014830, filed Jan. 30, 2017 and No. 2017-014831, filed Jan. 30, 2017. The entire disclosure of Japanese Patent Applications No. 2017-014830 and No. 2017-014831 are hereby incorporated herein by reference.

REFERENCE SIGNS LIST

11 . . . Printing device, 12 . . . Transport device, 13 . . . Printing unit, 14 . . . Medium support unit, 15 . . . Tension imparting unit, 17 . . . Detector, 18 . . . Biasing force adjustment unit, 19 . . . Braking force generating unit, 21 . . . Feeding unit, 22 . . . Winding unit as one example of second transport unit, 22M . . . Winding motor, 23 . . . Transport mechanism as one example of first transport unit, 23*a* . . . Transport roller pair, 23M . . . Transport motor, 24 . . . First support unit, 25 . . . Second support unit, 26 . . . Third support unit, 31 . . . Recording head, 32 . . . Carriage, 33 . . . Carriage moving unit, 41 . . . Control unit, 43 . . . CPU, 44 . . . Control circuit, 52 . . . Counter weight, 53 . . . Pivoting shaft, 53*a* . . . Pivoting fulcrum, 54 . . . Arm, 55 . . . Tension bar as one example of tension imparting member, 56 . . . Electric motor as one example of drive source, 60 . . . Sensor unit, 61 . . . Upper limit sensor, 62 . . . Lower limit sensor, 74 . . . Spring, 75 . . . Detector, 76 . . . Detected unit, 77 . . . Sensor, 83 . . . Detector, 84 . . . Spring, 85 . . . Detected unit, 86 . . . Sensor, 91 . . . Braked member, 92 . . . Frictional member, 93 . . . Electric motor, 100 . . . Center of gravity shift mechanism, 101 . . . Weight portion, 102 . . . Movement mechanism, 105 . . . Electric motor, 110 . . . Medium detector as one example of detector, 120 . . . Tension bar position detector as one example of tension imparting member position acquisition unit, 130 . . . Medium position detector as one example of medium position acquisition unit, M . . . Medium, R2 . . . Roll body, θ . . . Inclination angle (pivoting angle), Ls . . . Distance threshold value, Vpf Transport speed, Vw . . . Winding speed, Fb . . . Braking force, ΔV . . . Relative speed, Fv Speed suppressing force

The invention claimed is:

1. A transport device comprising:

a first transport unit;

a second transport unit disposed downstream of the first transport unit in a transport direction;

a tension imparting unit provided with a tension imparting member biased toward a medium between the first transport unit and the second transport unit and configured to impart tension to the medium;

an adjustment unit configured to adjust at least one of a biasing force of the tension imparting member and a relative speed between the tension imparting member and the medium; and a detector configured to detect the tension imparting member approaching the medium when a distance therebetween is less than or equal to a distance threshold value, wherein when the detector detects the approach, the adjustment unit adjusts a relative speed between the tension imparting member and the medium to be less than a relative speed obtained when adjustment is not performed.

2. The transport device according to claim 1, wherein the detector is provided to the tension imparting member.

3. The transport device according to claim 1, wherein the detector is of contact type implementing detection by contacting with the medium.

4. The transport device according to claim 1, wherein when the detector detects the tension imparting unit and the medium approaching each other so that a distance therebetween is less than or equal to the distance threshold value, the adjustment unit adjusts the relative speed by controlling the second transport unit.

5. The transport device according to claim 1, wherein the adjustment unit includes a biasing force adjustment unit configured to adjust a biasing force of the tension imparting member, and when the detector detects the tension imparting member and the medium approaching each other so that a distance therebetween is less than or equal to the distance threshold value, the biasing force adjustment unit adjusts the biasing force of the tension imparting member to be smaller in comparison with a biasing force obtained when adjustment is not performed.

6. The transport device according to claim 5, wherein when the detector detects the tension imparting member and the medium approaching each other so that a distance therebetween is less than or equal to the distance threshold value, the biasing force adjustment unit imparts a braking force to the tension imparting member.

7. The transport device according to claim 1, wherein the detector includes a tension imparting member position acquiring unit configured to acquire a position of the tension imparting member, and a medium position acquiring unit configured to acquire a position of the medium, and detects the tension imparting member and the medium approaching each other so that a distance therebetween is less than or equal to the distance threshold value, based on the position of the tension imparting member acquired by the tension imparting member position acquiring unit and the position of the medium acquired by the medium position acquiring unit.

8. The transport device according to claim 1, wherein the adjustment unit includes a biasing force adjustment unit configured to adjust a biasing force of the tension imparting member, and when the detector detects the tension imparting member and the medium approaching each other, the biasing force adjustment unit adjusts the biasing force of the tension imparting member to be smaller.

9. The transport device according to claim 8, wherein the detector is of contact type implementing detection by contacting with the medium.

10. The transport device according to claim 8, wherein the biasing force adjustment unit is a braking force generating unit configured to generate in the tension imparting unit a braking force in a direction of reducing the biasing force.

11. The transport device according to claim 10, wherein the braking force generating unit generates the braking force by applying a load to the tension imparting unit, the load being obtained by any one of a driving force of a drive source, a frictional load, a viscous load, an elastic load, and a center-of-gravity shift of the tension imparting unit.

12. The transport device according to claim 10, wherein the braking force generating unit is configured to adjust the braking force generated in the tension imparting unit.

13. The transport device according to claim 12, wherein the braking force generating unit changes the braking force in accordance with a position of the tension imparting member when the first transport unit starts transporting the medium.

14. A printing device comprising:

the transport device according to claim 1; and a printing unit configured to perform printing on the medium transported by the transport device.

15. A transport device comprising:

a first transport unit;

a second transport unit disposed downstream of the first transport unit in a transport direction;

a tension imparting unit provided with a tension imparting member biased toward a medium between the first transport unit and the second transport unit and configured to impart tension to the medium;

an adjustment unit configured to adjust at least one of a biasing force of the tension imparting member and a relative speed between the tension imparting member and the medium; and a detector configured to detect the tension imparting member approaching the medium when a distance therebetween is less than or equal to a distance threshold value, wherein the adjustment unit includes a biasing force adjustment unit configured to adjust a biasing force of the tension imparting member, and when the detector detects the tension imparting member and the medium approaching each other, the biasing force adjustment unit adjusts the biasing force of the tension imparting member to be smaller.

* * * * *